US005805149A

United States Patent [19]

Yuki et al.

[11] Patent Number: 5,805,149

[45] Date of Patent: Sep. 8, 1998

[54] DISPLAY CONTROL DEVICE AND DISPLAY APPARATUS WITH DISPLAY CONTROL DEVICE

[75] Inventors: Osamu Yuki, Atsugi; Hiroshi Inoue, Yokohama, both of Japan

[73] Assignee: Canon Kabushiki Kaisha, Tokyo, Japan

[21] Appl. No.: 337,456

[22] Filed: Nov. 4, 1994

Related U.S. Application Data

[63] Continuation of Ser. No. 967,391, Oct. 28, 1992, abandoned.

[30] Foreign Application Priority Data

Oct. 28, 1991 [JP] Japan ..... 3-307151

[51] Int. Cl.[6] ..... G09G 5/00

[52] U.S. Cl. ..... 345/202; 345/132; 345/127

[58] Field of Search ..... 345/127, 132, 345/202

[56] References Cited

U.S. PATENT DOCUMENTS

| | | | |
|---|---|---|---|
| 4,922,241 | 5/1990 | Inoue et al. . | |
| 4,990,902 | 2/1991 | Zenda | 345/127 |
| 5,029,228 | 7/1991 | Nomoyama et al. | 345/127 |
| 5,119,082 | 6/1992 | Lumelsky et al. | 340/731 |
| 5,150,462 | 9/1992 | Takeda et al. | 345/201 |
| 5,189,401 | 2/1993 | Kugler et al. | 345/132 |

FOREIGN PATENT DOCUMENTS

| | | | |
|---|---|---|---|
| 343539 | 11/1989 | European Pat. Off. . | |
| 89/10609 | 2/1989 | Japan | 340/731 |
| 6358865 | 9/1989 | Japan . | |
| 2156288 | 6/1990 | Japan . | |
| 2237713 | 5/1991 | United Kingdom . | |

*Primary Examiner*—Amare Mengistu

*Attorney, Agent, or Firm*—Fitzpatrick,Cella, Harper & Scinto

[57] ABSTRACT

A display device includes a display having a plurality of pixels and a signal processor for processing first image data, corresponding to a first number of pixels in the display, to display second image data corresponding to a second number of pixels which is less than the first number of pixels in the display. The signal processor includes thinning out circuitry for receiving a series of plural clock pulses synchronized with the first image data, and for outputting a series of thinned out clock pulses formed by thinning out the received clock pulses at a compression ratio, thereby compressing the first image data. The signal processor also includes circuitry for extending the compressed first image data in a ratio different from the inverse of the compression ratio in accordance with the first pixel number so that one pixel of the compressed first image data corresponds to two or more of the pixels of the display.

26 Claims, 27 Drawing Sheets

BLANK FROM GRAPHIC CONTROLLER 2
BLK
IMAGE DATA TRANSFER CLOCK FROM GRAPHIC CONTROLLER 2
DOTCLK
201
F·F
D
Q
202
F·F
D
Q
203
204
SHIFT REGISTER
205
COMPARATOR
PS¹
PSⁿ
SET VALUE START [11 : 0] FROM MPU 80
VCC
RESET
D
Q
CK
210
211
206
F·F
D
Q
207
RESET
COUNTER
PC¹
PCⁿ
208
COMPARATOR
SET VALUE DIST [11 : 0] FROM MPU 80
209
212
TO THIN OUT CLOCK DCLK PIXEL SELECTOR 150

FIG.14

| MODE | CRT (17) | MIS | GRA (5) | GRA (6) | SEQ (1) |
|---|---|---|---|---|---|
| $0^+$, $1^+$ | A3 | 67 | 10 | 0E | 08 |
| $2^+$, $3^+$ | A3 | 67 | 10 | 0E | 00 |
| $7^+$ | A3 | 66 | 10 | 0A | 00 |
| 4 ,5 | A2 | 63 | 30 | 0F | 09 |
| 6 | C2 | 63 | 00 | 00 | 00 |
| D | E3 | 63 | 00 | 00 | 09 |
| E | E3 | 63 | 00 | 05 | 01 |
| F | E3 | A2 | 00 | 05 | 01 |
| 10 | E3 | A3 | 00 | 05 | 01 |
| 11 | C3 | E3 | 00 | 05 | 01 |
| 12 | E3 | E3 | 00 | 05 | 01 |
| 13 | A3 | 63 | 40 | 05 | 01 |

FIG.15

| | VERTICAL SYNCHRONIZING (LINE) [HEX] | | HORIZONTAL SYNCHRONIZING (CLOCK) [HEX] | |
|---|---|---|---|---|
| MODE | START FRONT PORCH | BACK PORCH END | START FRONT PORCH | BACK PORCH END |
| $0^+$, $1^+$ | 24C | 3DC | CCF | FCF |
| $2^+$, $3^+$ | 24C | 3DC | CCF | FCF |
| $7^+$ | 24C | 3DC | CCF | FCF |
| 4 , 5 | 24C | 3DC | CCF | FCF |
| 6 | 24C | 3DC | CCF | FCF |
| D | 24C | 3DC | CCF | FCF |
| E | 24C | 3DC | CCF | FCF |
| F | 274 | 3B4 | CCF | FCF |
| 10 | 274 | 3B4 | CCF | FCF |
| 11 | 1FE | 3DE | CCF | FCF |
| 12 | 1FE | 3DE | CCF | FCF |
| 13 | 24C | 3DC | CCF | FCF |

FIG.16

| MODE | BIT 2 | BIT 1 | BIT 0 |
|---|---|---|---|
| $0^+$, $1^+$ | 0 | 1 | 0 |
| $2^+$, $3^+$ | 0 | 1 | 0 |
| 4 , 5 | 1 | 0 | 0 |
| 6 | 0 | 0 | 0 |
| $7^+$ | 0 | 1 | 0 |
| D | 1 | 0 | 0 |
| E | 0 | 0 | 0 |
| F | 0 | 0 | 1 |
| 10 | 0 | 0 | 1 |
| 11 | 0 | 1 | 1 |
| 12 | 0 | 1 | 1 |
| 13 | 1 | 0 | 0 |

FIG.19

| CRT GRADATION INFORMATION | FLC GRADATION INFORMATION | | | |
|---|---|---|---|---|
| R (H) x 2+G (H) x 3+B (H) x 1 | MSB | | | LSB |
| 00 - 18 (H) | 0 | 0 | 0 | 0 |
| 19 - 36 (H) | 0 | 0 | 1 | 0 |
| 37 - 51 (H) | 1 | 0 | 0 | 0 |
| 52 - 6C (H) | 0 | 0 | 0 | 0 |
| 6D - 87 (H) | 0 | 1 | 0 | 0 |
| 88 - A2 (H) | 1 | 0 | 1 | 0 |
| A3 - BD (H) | 0 | 0 | 1 | 1 |
| BE - D8 (H) | 0 | 1 | 1 | 0 |
| D9 - F3 (H) | 0 | 1 | 0 | 1 |
| F4 - 10E (H) | 1 | 0 | 1 | 1 |
| 10F - 129 (H) | 1 | 1 | 1 | 0 |
| 12A - 144 (H) | 0 | 1 | 1 | 1 |
| 145 - 15F (H) | 1 | 1 | 0 | 1 |
| 160 - 180 (H) | 1 | 1 | 1 | 1 |

4-PIXEL/PIXEL

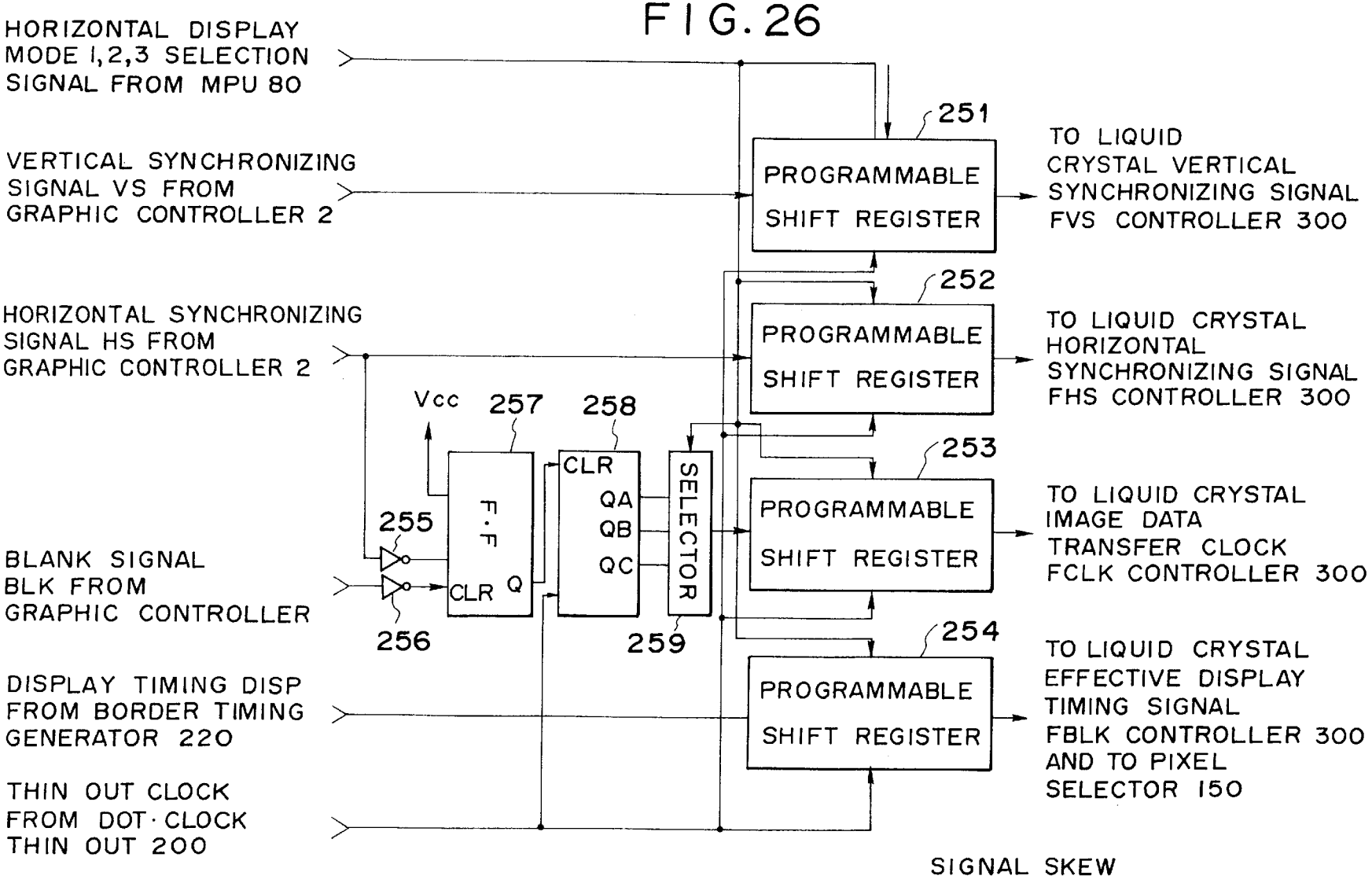
FIG. 26
HORIZONTAL DISPLAY MODE 1,2,3 SELECTION SIGNAL FROM MPU 80
VERTICAL SYNCHRONIZING SIGNAL VS FROM GRAPHIC CONTROLLER 2
HORIZONTAL SYNCHRONIZING SIGNAL HS FROM GRAPHIC CONTROLLER 2
BLANK SIGNAL BLK FROM GRAPHIC CONTROLLER
DISPLAY TIMING DISP FROM BORDER TIMING GENERATOR 220
THIN OUT CLOCK FROM DOT·CLOCK THIN OUT 200
251
PROGRAMMABLE SHIFT REGISTER
TO LIQUID CRYSTAL VERTICAL SYNCHRONIZING SIGNAL FVS CONTROLLER 300
252
PROGRAMMABLE SHIFT REGISTER
TO LIQUID CRYSTAL HORIZONTAL SYNCHRONIZING SIGNAL FHS CONTROLLER 300
253
PROGRAMMABLE SHIFT REGISTER
TO LIQUID CRYSTAL IMAGE DATA TRANSFER CLOCK FCLK CONTROLLER 300
254
PROGRAMMABLE SHIFT REGISTER
TO LIQUID CRYSTAL EFFECTIVE DISPLAY TIMING SIGNAL FBLK CONTROLLER 300 AND TO PIXEL SELECTOR 150
SIGNAL SKEW
SELECTOR
259
258
CLR
QA
QB
QC
257
F·F
CLR
Q
Vcc
255
256

DISPLAY CONTROL DEVICE AND DISPLAY APPARATUS WITH DISPLAY CONTROL DEVICE

This application is a continuation, of application Ser. No. 07/967,391 filed Oct. 28, 1992, now abandoned.

BACKGROUND OF THE INVENTION

1. Field of the Invention

The present invention relates to a display control device and a display apparatus with the display control device and, more particularly, to a display control device and a display apparatus with the display control device, which can display image data supplied from a host apparatus together with an image data transfer clock on a display apparatus (digital display apparatus) having matrix electrodes in a proper size.

2. Related Background Art

Conventionally, personal computers (to be abbreviated to as PCs hereinafter) have no standards of the sizes of video signals to be displayed on a display apparatus, and there are many modes for determining the number of picture elements in the horizontal/vertical scanning period.

A conventional display example will be described below with reference to FIGS. 1(*a*), 1(*b*), 2(*a*) and 2(*b*).

For example, in order to cope with the above-mentioned modes, a display control device sets a portion other than a display portion corresponding to a region where image information is displayed as a border display portion corresponding to a non-display region of image information, as shown in FIGS. 1(*a*) and 1(*b*), or enlarges a display portion to $2^n$ times, as shown in FIGS. 2(*a*) and 2(*b*), or combines the border display and the $\times 2^n$ display. FIGS. 1(*a*)–1(*b*) and 2(*a*)–2(*b*) respectively show cases wherein image data having 1,024×768 dots and 640×480 dots as display picture elements are to be displayed on a display apparatus having 1,280×1,024 display physical picture elements. In FIGS. 1(*a*) and 1(*b*), an image is displayed on a 1,024×768 dot portion 521, having the same number of picture elements as that of image data, of the 1,280 ×1,024 display physical picture elements of a display apparatus 500, and black dots are displayed on the remaining portion as a border display portion 522. In FIGS. 2(*a*) and 2(*b*), when 640×480 dot image data is border-displayed on the 1,280×1,024 dot display apparatus 500 without any modifications, a region ¼ or less of the image display region of the display apparatus can only be used as the display region. For this reason, in FIGS. 2(*a*) and 2(*b* ), image data is enlarged twice in both the vertical and horizontal directions to obtain 1,280×960 dot picture element data, and the enlarged data is displayed on the display region. The remaining non-display regions are displayed as border portions. In FIGS. 1(*a*)–1(*b*) and 2(*a*)–2(*b*), the display apparatus 500 has the display portion (display screen) 511 or 521 and the border portions 512 and 513 or 522.

However, when a display apparatus having a specific number of picture elements is set to have versatility for a plurality of horizontal display modes, a conventional combination of the border display and the $\times 2_n$ display is not satisfactory. For example, as shown in FIG. 3(*a*), when an image having a horizontal display size of 720 dots is to be displayed on a display apparatus having a horizontal display physical picture element size of 1,280 dots, if the image is enlarged to $\times 2^n$ and is displayed, a portion (720×2−1,280= 160 dots) of the horizontal display of the image is not displayed. On the other hand, as shown in FIG. 3(*b*), when the remaining portion of the image having the horizontal display size of 720 dots is set as a border portion, 560 dots (=1,280−720) correspond to a border display portion 502, and a display portion 501 of the actual image becomes very small. Thus, the capacity of the display apparatus cannot be sufficiently utilized.

In a digital display apparatus, which receives horizontal and vertical synchronizing signals as standard signals to a cathode ray tube (to be abbreviated to as a CRT hereinafter), and an analog image signal from a computer, and displays an image, a method of thinning out or interpolating image data by controlling an A/D conversion period upon conversion of the analog image signal into digital image data is known. However, with this A/D conversion period control method, since the position of image data to be thinned out cannot be set, image data which should not be thinned out may be thinned out.

SUMMARY OF THE INVENTION

The present invention has been made in consideration of the conventional problems, and has as its object to provide a display control device and a display apparatus with the display control device, which can provide a proper horizontal display size without deteriorating display quality even when the number of horizontal physical display picture elements of the display apparatus and the number of horizontal display picture elements of picture element data have a relationship shown in FIGS. 3(*a*) and 3(*b*) therebetween.

It is another object of the present invention to provide a display control device, which receives display image data transfer dot clocks and image data synchronous with the clocks, and displays, as an image, the image data on a display apparatus having matrix electrodes, comprising means for displaying the image on a display screen in an arbitrary horizontal display size by thinning out the dot clocks.

It is still another object of the present invention to provide a display apparatus comprising: display means having a plurality of substrates on each of which a plurality of electrodes are arranged parallel to or substantially parallel to each other, the substrates being arranged to oppose each other so that the electrodes extend orthogonally with each other, and a liquid crystal material sealed between the substrates; a display control device which receives image data transfer clocks, and image data synchronous with the transfer clocks, and has thin-out means for thinning out the input image data transfer clocks; and a controller for receiving signals from the display control device, and performing a display on the display means.

BRIEF DESCRIPTION OF THE DRAWINGS

FIG. 14 shows a mode discrimination table used by the MPU;

FIG. 15 shows a porch setting value table in the MPU;

FIG. 16 shows a table showing RMOD[2:0] codes of the MPU;

FIG. 19 is a table showing gradation conversion examples executed by the MPU;

FIG. 26 is a circuit diagram of a signal skew section shown in FIG. 5.

DETAILED DESCRIPTION OF THE PREFERRED EMBODIMENT

According to the present invention, in order to display image data on display means in an optimal size with a small border portion, image data transfer dot clocks DOTCLK are thinned out, and the image data is re-arranged as one for the display means in synchronism with the thin-out image data transfer dot clocks.

Figure 5:
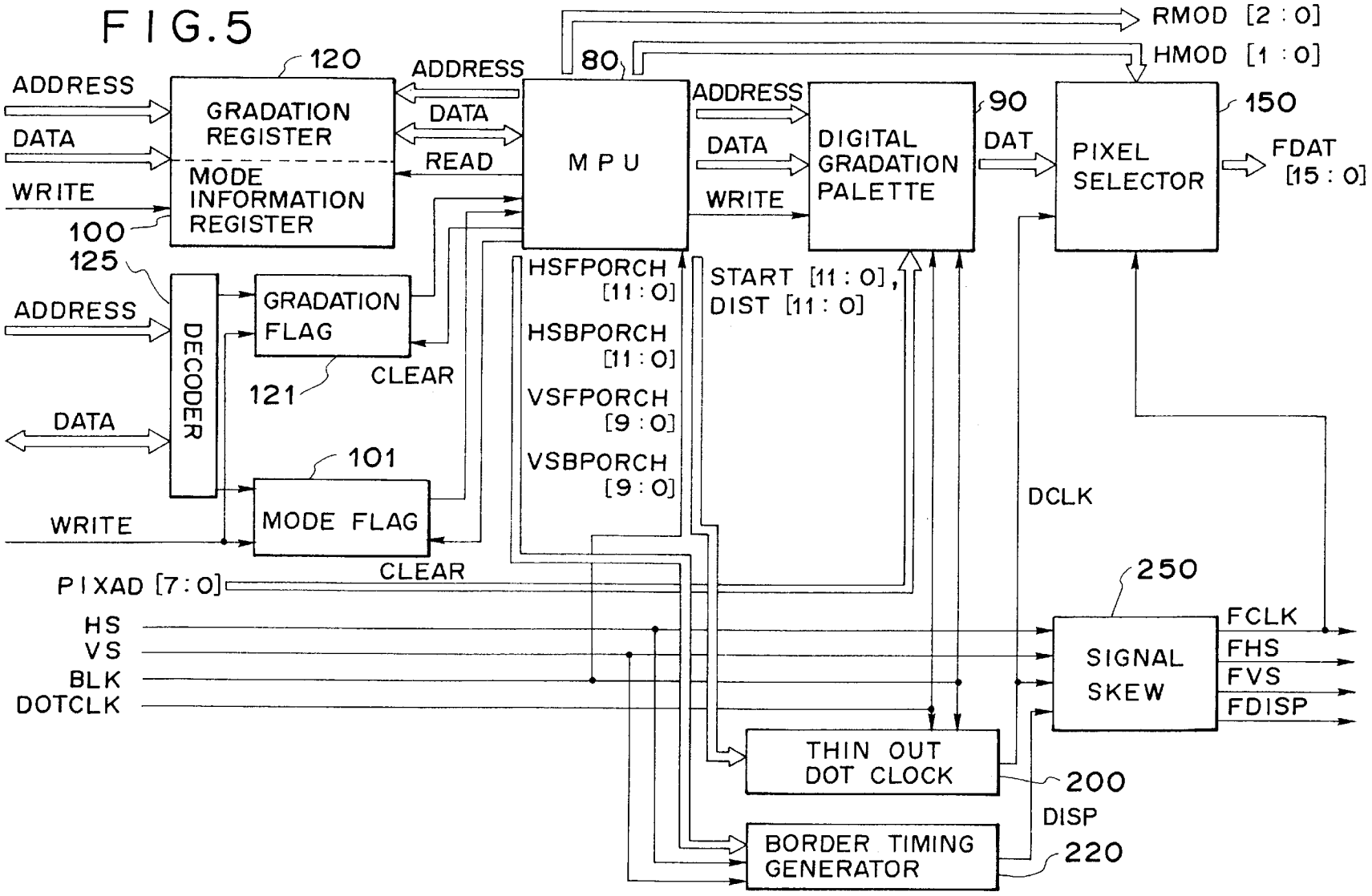
FIG. 5 is a block diagram showing the details of a display control device shown in FIG. 4.

More specifically, the above-mentioned object is achieved by a dot clock thin-out section 200 for thinning out image data transfer dot clocks DOTCLK input in synchronism with image data from arbitrary positions at an arbitrary period, a pixel selector 150 for increasing the number of display picture elements to $2^n$ times, and a border timing generator 220, as shown in FIG. 5. The dot clock thin-out section 200 has a means for setting a thin-out start position and a period. With this means, only data which do not influence an image can be thinned out from image data. The pixel selector 150 can increase the number of display picture elements to $2_n$ times, and image data can be thinned out or interpolated by a combination of the dot clock thin-out section 200 and the pixel selector 150.

According to the present invention, dot clocks for one horizontal scan period are thinned out to a number conservatively closest to the number of effective horizontal picture elements/$2^n$ of the display apparatus by the dot clock thin-out section 200, and image data is expanded by a factor of $2^k$ by the pixel selector 150, so that an image can be displayed on the display apparatus in an optimal size with a small border portion. Setting of thin-out positions allows to thin out image data which does not influence an image. If a display including a border portion is to be performed on the display apparatus for some reason, it can be realized by adjusting the thin-out interval. Therefore, with the apparatus of the present invention, even when the original number of image data does not coincide with the specific number of picture elements of the display apparatus, an optimal horizontal display size can be obtained.

[Embodiment]

The present invention will be described in detail below with reference to its preferred embodiment. The description will be made in the following order.

Figure 4:
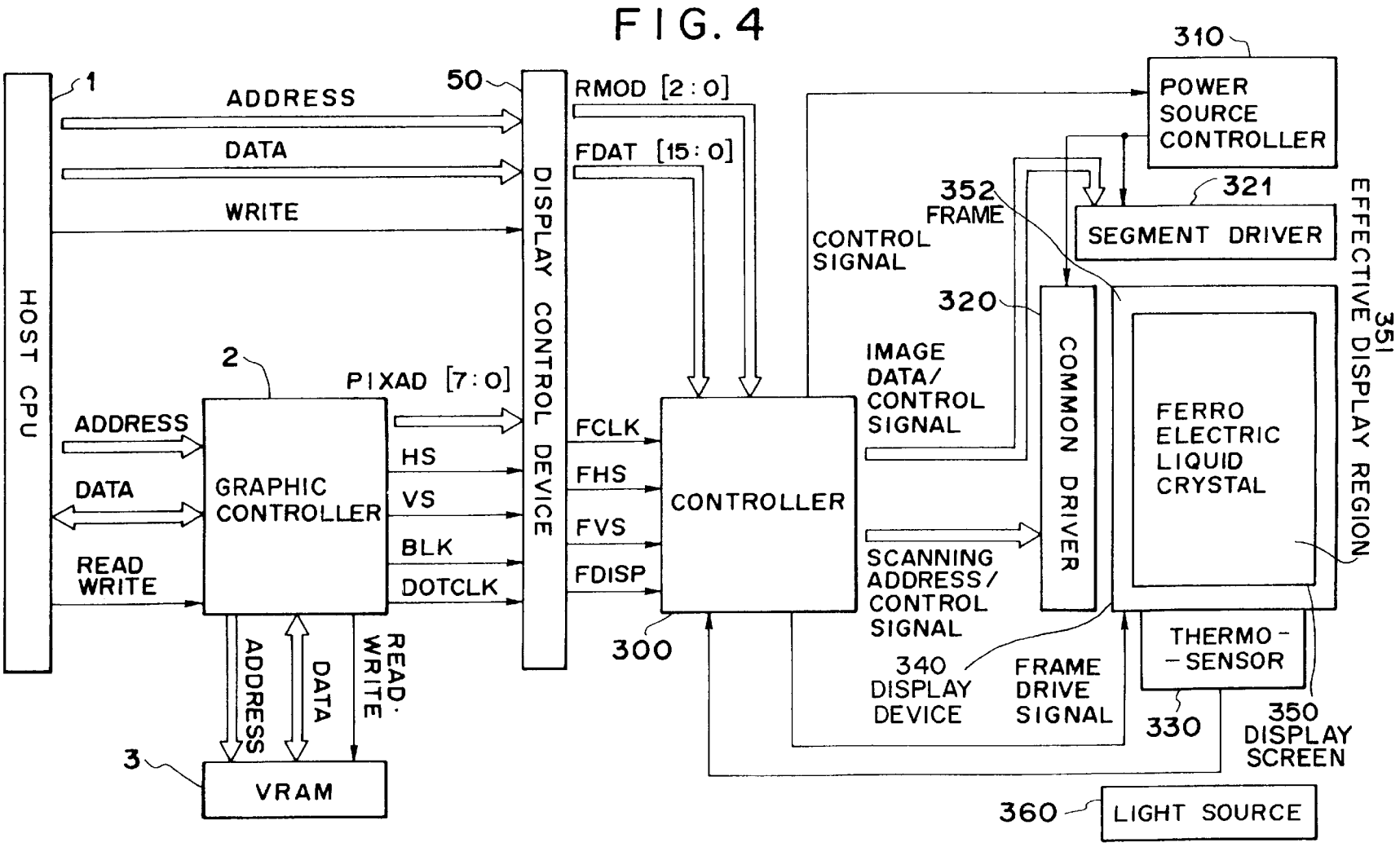
FIG. 4 is a block diagram showing the arrangement of the overall display apparatus according to an embodiment of the present invention.

(1) Outline of Apparatus
(2) Outline of Display Control
(3) Arrangement of Respective Sections of Display Control Device
  (3.1) Dot Clock Thin-out Section
    (3.1.1) Circuit Arrangement of Dot Clock Thin-out Section
  (3.2) Border Timing Generator
    (3.2.1) Circuit Arrangement of Border Timing Generator
  (3.3) Mode Information Register
    (3.3.1) Arrangement of Mode Information Register
  (3.4) Gradation Register
    (3.4.1) Arrangement of Gradation Register
  (3.5) Information Processing Section
    (3.5.1) Mode Information Identification Processing
    (3.5.2) Gradation Conversion Processing
  (3.6) Output Controller
    (3.6.1) Arrangement of Digital Gradation Palette
    (3.6.2) Arrangement of Pixel Selector
      (3.6.2.1) Circuit Arrangement of [2-picture element/pixel] Output Unit
      (3.6.2.2) Circuit Arrangement of [4-picture element/pixel] Output Unit
      (3.6.2.3) Circuit Arrangement of [8-picture element/pixel] Output Unit
    (3.6.3) Circuit Arrangement of Signal Skew Section (1) Outline of Apparatus FIG. 4 shows the arrangement of the overall display apparatus according to an embodiment of the present invention, and FIG. 5 shows the details of a display control device 50 shown in FIG. 4. In FIG. 4, a host CPU 1 supplies control signals such as an address signal, a data signal, a read/write signal, and the like to a graphic controller 2 and the display control device 50 through an expansion bus. The graphic controller 2 as an LSI normally used for CRT display has many modes in correspondence with the display sizes and the number of display colors, and outputs various signals for designating these modes. In this embodiment, a horizontal synchronizing signal HS, a vertical synchronizing signal VS, image data transfer clocks DOTCLK, a blank signal BLK, and a pixel address PIXAD output from the graphic controller 2 are used. A VRAM 3 is a frame memory for storing image data in combination with the controller 2.

The display control device 50 for explaining the embodiment of the present invention is constituted by a mode information register 100, a gradation register 120, an MPU 80, the dot clock thin-out section 200, the border timing generator 220, a signal skew section 250, a digital gradation palette 90, the pixel selector 150, and the like as functional blocks, as shown in FIG. 5. The display control device 50 reads data through the bus of the CPU 1, and performs gradation conversion processing or mode identification processing on the basis of the read data, thereby generating image data FDAT[15:0], liquid crystal image data transfer clocks FCLK, a liquid crystal horizontal synchronizing signal FHS, a liquid crystal vertical synchronizing signal FVS, and a liquid crystal display enable signal FDISP, which are suitable for a ferroelectric liquid crystal display device 340 used in this embodiment. These signals are supplied to a controller 300 shown in FIG. 4.

The controller 300 discriminates the number of vertical lines on the basis of a line mode RMOD[2:0] signal supplied from the MPU 80 shown in FIG. 5, and supplies a control signal for simultaneously driving one or a plurality of scanning lines of the display device 340 to a common driver 320 (FIG. 4) and image data to a segment driver 321 (FIG. 4). The controller 300 also drives a frame (border) 352 as a non-display region of the display screen. A thermosensor 330 is arranged at an appropriate position in the display device 340. The controller 300 receives temperature information from the thermosensor 330, and performs generation of a driving waveform to the display device 340 and interlaced scanning control.

A power source controller 310 appropriately boosts a voltage set by the controller 300 to control the voltage to be applied from the display drivers 320 and 321 to display elements of the display device 340.

In the display device 340, ITO transparent electrodes of two glass plates having scanning line or information line extraction electrodes and the ITO electrodes connected to these electrodes are arranged in orthogonal directions (in a matrix), a ferroelectric liquid crystal having a bistable state is sealed between the two glass plates, and a deflector is arranged in crossed Nicols with respect to the orientation direction of elements. In this embodiment, a light source 360 is arranged below the ferroelectric liquid crystal, having the bistable state, of a display screen 350 to perform a display operation by controlling the optical modulation elements. The number of picture elements of the display device 340 is constituted by 1,024×2,560 dots (1,024 scanning line electrodes ×2,560 information line electrodes). The optical modulation elements are controlled by an electric field generated by a driving waveform supplied to the segment driver 321, and perform a display in a "brightp" or "dark" state. The details of the power source controller 310, the thermosensor 330, the frame 352, and the like are described in U.S. Pat. No. 4,922,241 proposed by Inoue et. al.

(2) Outline of Display Control Device

The gradation register 120 in the display control device 50 shown in FIG. 5 stores gradation information for the CRT, which is supplied from the host CPU 1 through the bus. The MPU 80 converts the luminance gradation information for the CRT into area gradation information used in the ferroelectric liquid crystal display device 340, and stores the converted information in 256 gradation look-up tables of the digital gradation palette 90 during the vertical blanking period. The gradation information in the palette 90 is selected by the pixel address PIXAD supplied from the graphic controller 2, and is supplied as image data DAT to the pixel selector 150. The palette 90 also receives a BLK signal from the graphic controller 2, and outputs border data during the low-level period of the received signal.

The pixel selector 150 is constituted by shift registers for thinning out the image data for area gradation supplied from the palette 90, and holding the thin-out data at the timings of the leading edges of clocks DCLK. The image data DAT is processed in units of pixels each consisting of a plurality of picture elements selected by a horizontal display mode HMOD[1:0] signal from the MPU 80. As a result, "thin-out clock DCLK×the number of picture elements per pixel ($2^n$ picture elements)" is obtained. The liquid crystal image data FDAT[15:0] is supplied to the controller 300 in a word length corresponding to a plurality of pixels so as to assure the processing time of the controller 300.

The dot clock thin-out section 200 thins out the blank signals BLK and the image data transfer clocks DOTCLK from the graphic controller 2, thereby adjusting the number of picture elements to be conservatively closest to the number of effective horizontal picture elements/$2^n$ of an effective display region 351 of the display device 340.

The border timing generator 220 receives the horizontal synchronizing signal HS and the vertical synchronizing signal VS from the graphic controller 2, and also receives a horizontal front porch HSFPORCH[11:0], a horizontal back porch HSBPORCH[11:0], a vertical front porch VSFPORCH[9:0], and a vertical back porch VSBPORCH [9:0] of the setting values from the MPU 80. The generator 220 generates a timing signal DISP for optimally displaying a border region on the frame 352 according to the horizontal and vertical display regions. The timing signal DISP is supplied to the controller 300 as the liquid crystal display enable signal FDISP through the signal skew section 250.

The signal skew section 250 adjusts the timings of the liquid crystal image data FDAT[15:0], the liquid crystal horizontal synchronizing signal FHS, the vertical synchronizing signal FVS, and the liquid crystal display enable signal FDISP. The signal skew section 250 also generates clocks FCLK for transferring 16-bit parallel image data to the controller 300.

Setting values START[11:0] and DIST[11:0] of the dot clock thin-out section 200, and setting values HSFPORCH [11:0], HSBPORCH[11:0], VSFPORCH[9:0], and VSBPORCH[9:0], and the horizontal display mode HMOD [1:0] signal, and the line mode signal RMOD[2:0] to the border timing generator 220 are supplied from the MPU 80. The MPU 80 identifies data stored in the mode information register 100 through the bus of the host CPU 1, and generates the setting values and the mode signals. With the above-mentioned display control, image data stored in the VRAM 3 can be optimally displayed on the ferroelectric liquid crystal display device 340 having 2,560×1,024 effective display picture elements.

(3) Arrangement of Respective Sections of Display Control Device (3.1) Dot Clock Thin-out Section The dot clock thin-out section 200 performs a thin-out operation of the image data transfer clocks DOTCLK supplied from the graphic controller 2. The setting values START[11:0] and DIST[11:0] supplied from the MPU 80 respectively designate a DOTCLK thin-out start position from the beginning of horizontal scanning, and the number of clocks from the DOTCLK thin-out start position to the next DOTCLK thin-out position, i.e., a thin-out interval. The thinned-out clocks DOTCLK are supplied to the pixel selector 150.

Figure 1B:
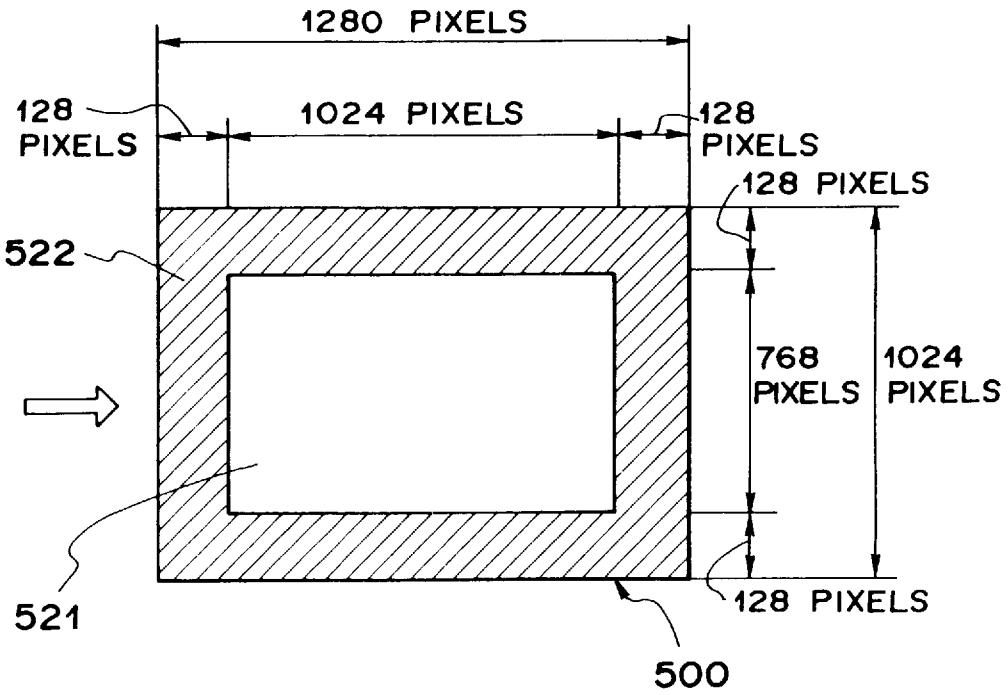
FIG. 1(b) PRIOR ART
FIGS. 1(*a*) and 1(*b*) together comprise an explanatory view showing a conventional border display state when an image displayed on a display apparatus is small.
Figure 1A:
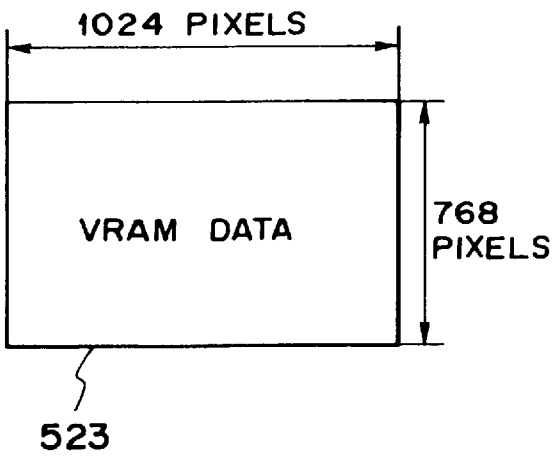
FIG. 1(a) PRIOR ART
Figure 2B:
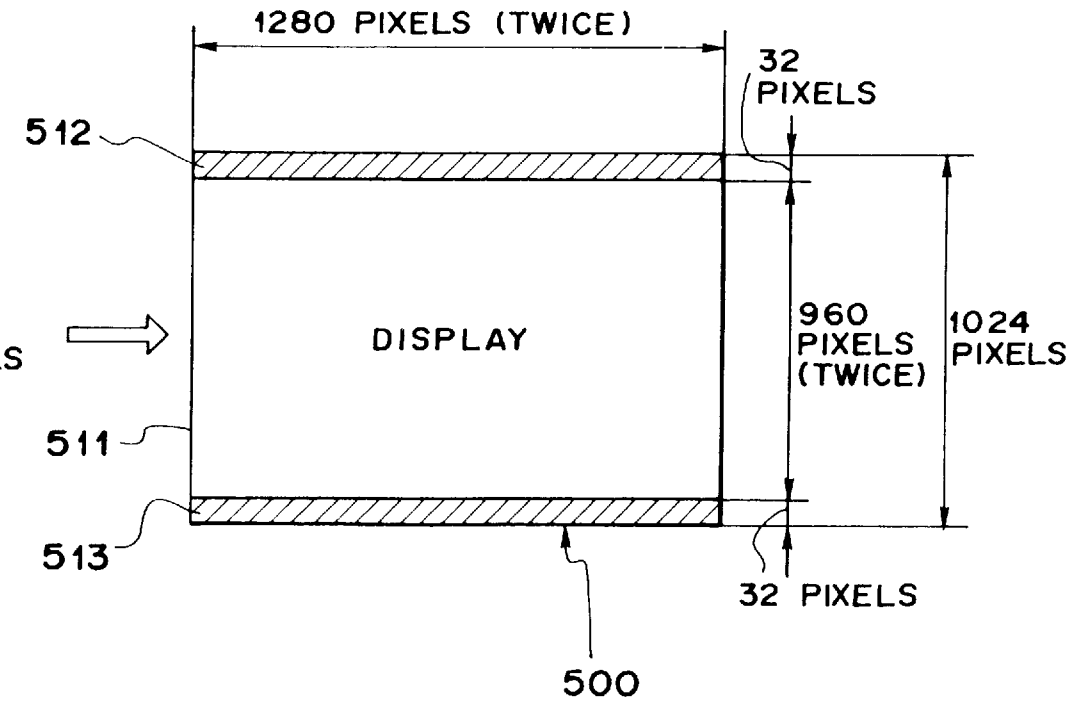
FIG. 2(b) PRIOR ART
FIGS. 2(*a*)–2(*b*) and 3(*a*)–3(*b*) are explanatory views for explaining conventional display methods.
Figure 2A:
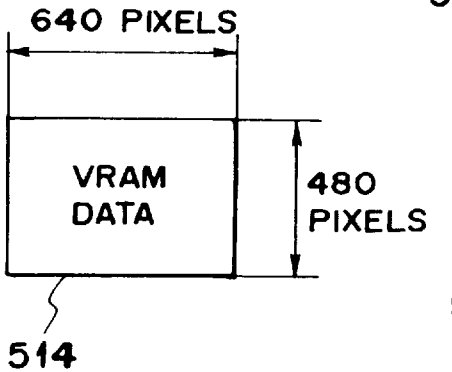
FIG. 2(a) PRIOR ART
Figures 3A, 3B:
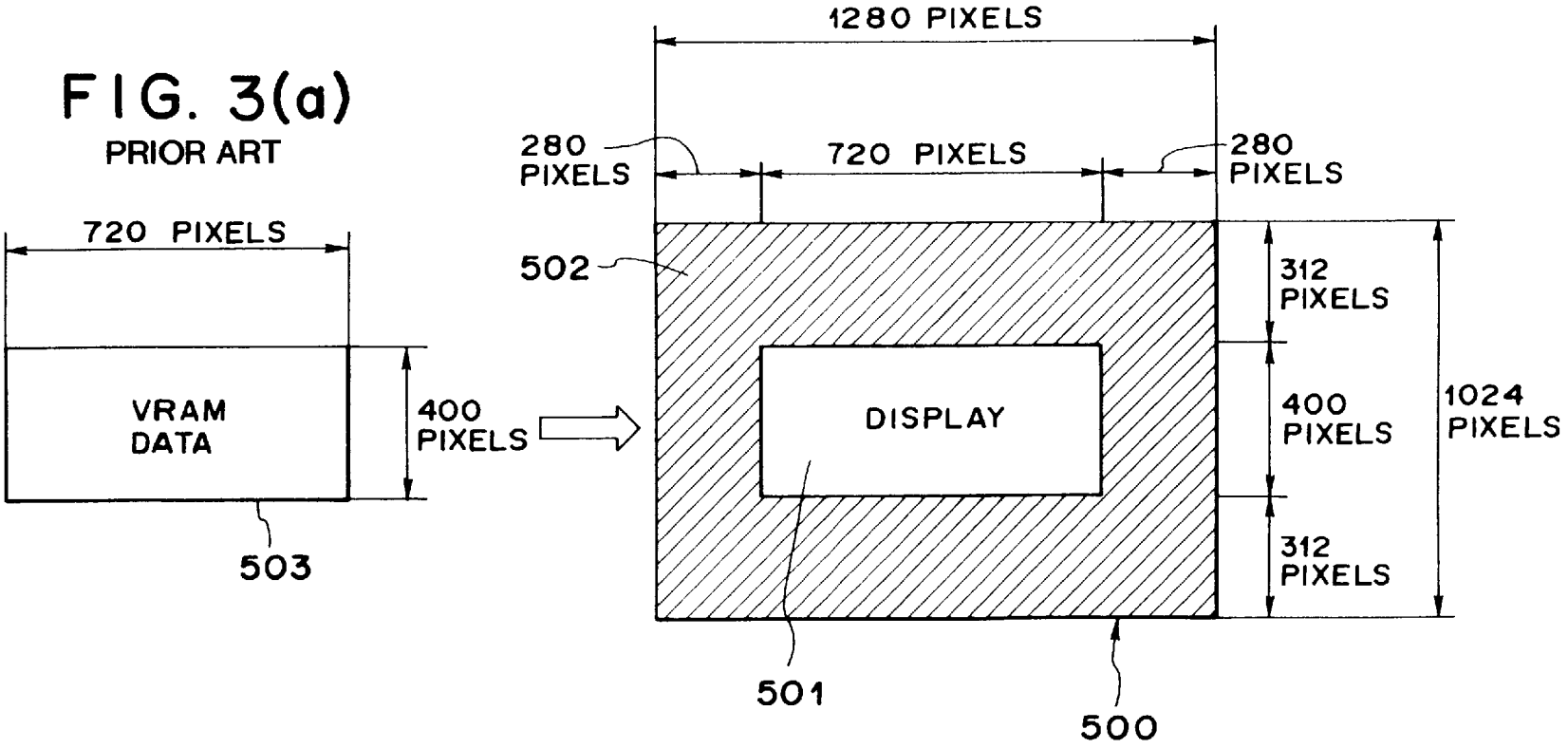
FIG. 3(b) PRIOR ART
FIG. 3(a) PRIOR ART

Modes $2^+$ and $3^+$ shown in FIG. 14 will be exemplified below. The picture element arrangement in these modes is 720×400, as shown in (*a*) of FIG. 3. In this case, since the number of picture elements of an effective display region 350 of the display device 340 is 2,560×1,024, the number of dots given by "$2{,}560/2^n$" conservatively closest to the number of horizontal display picture elements of 720 dots is 640 picture elements. Therefore, 640/720=8/9, and a thin-out operation from 720 picture elements to 640 picture elements can be attained by thinning out one dot at 9-dot intervals. In this case, it must also be taken in consideration that the dots which do not influence the display on the display device 340 are thinned out. A character font in each mode is constituted by 9×16 dots, and the 9th dot in the horizontal direction corresponds to a space. Therefore, in order to thin out one dot space to obtain an 8×16 character font, "START=9 and DIST=9" can be set. Based on these setting values, the clocks DOTCLK are thinned out by the thin-out section 200, and thin-out clocks DCLK for 640 dots are generated. In this state, however, the display frame is very small.

The pixel selector 150 receives the thin-out clocks DCLK, and latches image data DAT at the leading edges of the clocks. The image data includes area gradation information of $2^n$ picture elements. The HMOD[1:0] signal supplied from the MPU 80 selects a pixel arrangement of [4 picture element/pixel]. Upon selection of this pixel arrangement, the image data of 640 picture elements is converted into image data of 2,560 (="640×4") picture elements, and the number of picture elements of the converted image data coincides with the number of effective display picture elements of the display device 340.

(3.1.1) Circuit Arrangement of Dot Clock Thin-out Section

Figure 6:
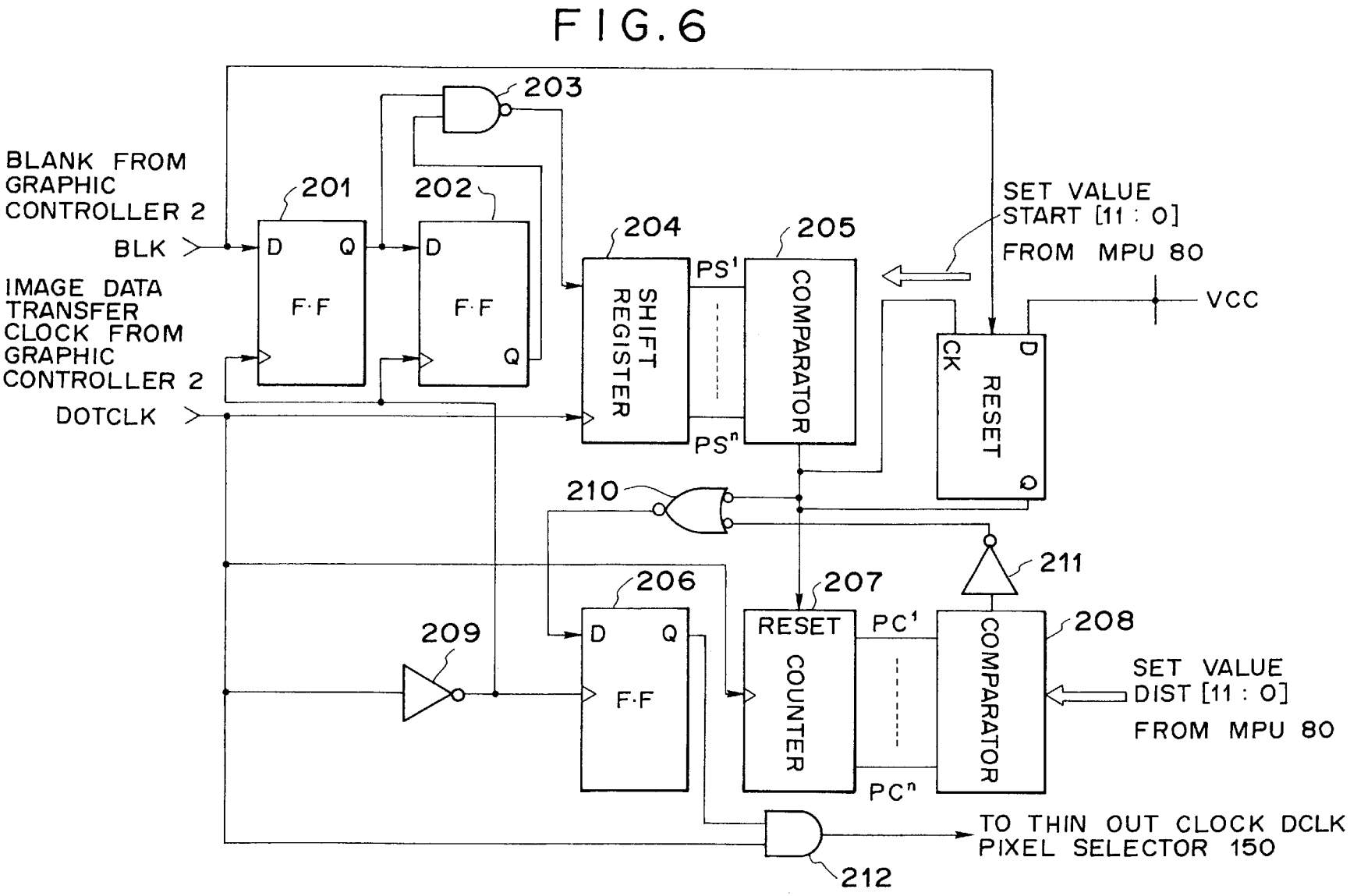
FIG. 6 is a circuit diagram of a dot clock thin-out section shown in FIG. 5.

The details of the dot clock thin-out section 200 will be described below. FIG. 6 is a circuit diagram of the dot clock thin-out section 200. Flip-flops 201 and 202 and a NAND gate 203 differentiate the leading edge of the blank signal BLK to generate a negative logic pulse. A shift register 204 delays the negative logic pulse based on the image data transfer clock DOTCLK.

The setting value START[11:0] designates the thin-out start position of the image data transfer clocks DOTCLK. Outputs $PC^1$ to $PC^n$ from the shift register 204 are compared with a value designated in a comparator 205, thereby generating a thin-out start timing. A comparator 208 determines a thin-out interval of the dot clocks DOTCLK based on a signal selected by the setting value DIST[11:0]. The output from a counter 207 for counting the image data transfer clocks DOTCLK is compared with a value designated in the comparator 208, thereby generating a thin-out interval timing. An inverter 211 inverts a coincidence signal output from the comparator 208.

A negative logic OR gate 210 outputs a low-level signal when one of the thin-out start signal from the comparator 205, and a signal obtained by inverting a thin-out interval signal from the comparator 208 by the inverter 211 is at low level.

A flip-flop 206 synchronizes a thin-out signal of the dot clock DOTCLK of the negative logic OR gate 210 using the inverted signal of the dot clock DOTCLK. This thin-out signal is at low level during a thin-out period of the dot clocks DOTCLK, and is at high level in other periods. The logical product of the thin-out signal and the dot clock DOTCLK is the thin-out clock DCLK. The logical product is obtained by an AND gate 212.

Figure 7:
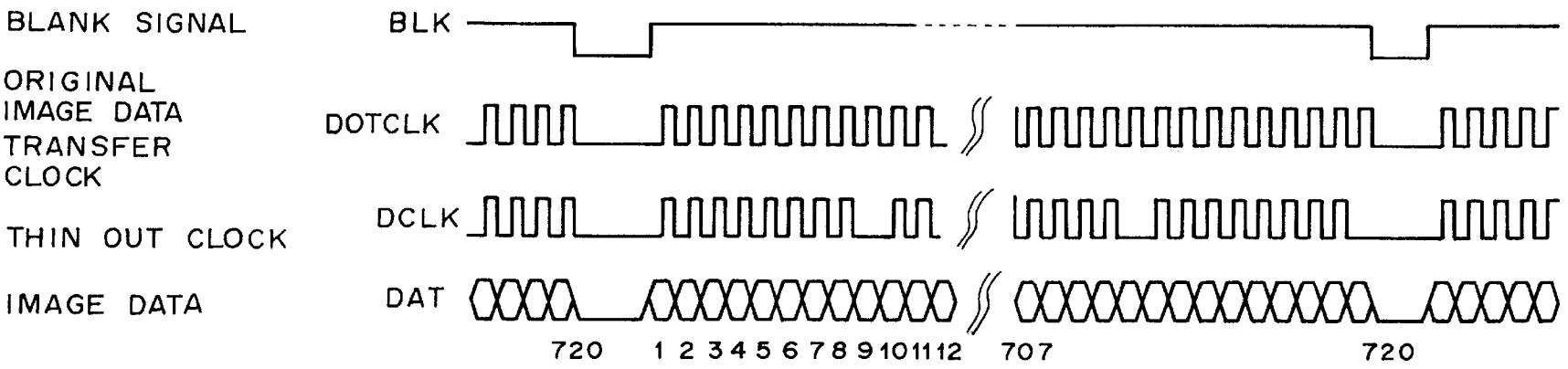
FIG. 7 is a timing chart of main signals in the circuit diagram of FIG. 6.

With the above-mentioned operations, the thin-out clocks DCLK are generated. When the thin-out start position =0 and the thin-out interval =9 are set, the relationship between the signals and image data is as shown in FIG. 7. First to 720th horizontal display data DAT have a one-to-one correspondence with 720 dot clocks DOTCLK. In contrast to this, in the thin-out clocks DCLK processed by the dot clock thin-out section 200, 8 clocks follow the blank signal BLK, and thereafter, the 9th bit is thinned out. When the dot clocks DOTCLK are thinned out at this interval up to the 720th clock, 640 thin-out clocks DCLK in one BLK period (one horizontal display period) are obtained. Since the image data DAT is fetched in synchronism with the thin-out clock DCLK, a horizontal display obtained by thinning out one picture element from every nine picture elements is performed.

(3.2) Border Timing Generator

Referring to FIGS. 4 and 5, the border timing generator 220 receives the horizontal and vertical synchronizing signals HS and VS from the graphic controller 2, and generates the horizontal front porch start and back porch end positions with reference to the horizontal synchronizing signal HS and the vertical front porch start and back porch end positions with reference to the vertical synchronizing signal VS. A low-level period from the horizontal front porch start position to the back porch end position, and a low-level period from the vertical front porch start position to the back porch end position are negatively logically added to each other, and the sum signal is supplied as the display enable signal DISP to the pixel selector 150 and the signal skew section 250. The timings of the respective porches are programmed by the horizontal synchronizing signal HSFPORCH[11:0], the horizontal synchronizing signal HSBPORCH[11:0], the vertical synchronizing signal VSFPORCH[9:0], and the vertical synchronizing signal VSBPORCH[9:0] as the setting values from the MPU 80. The display enable signal DISP is supplied to the signal skew section 250, so that its timing is adjusted with respect to the liquid crystal clocks FCLK, the synchronizing signals FHS and FVS, and the image data FDAT, and thereafter, the signal is supplied to the controller 300 as the liquid crystal display enable signal FDISP.

(3.2.1) Circuit Arrangement of Border Timing Generator

Figure 8:
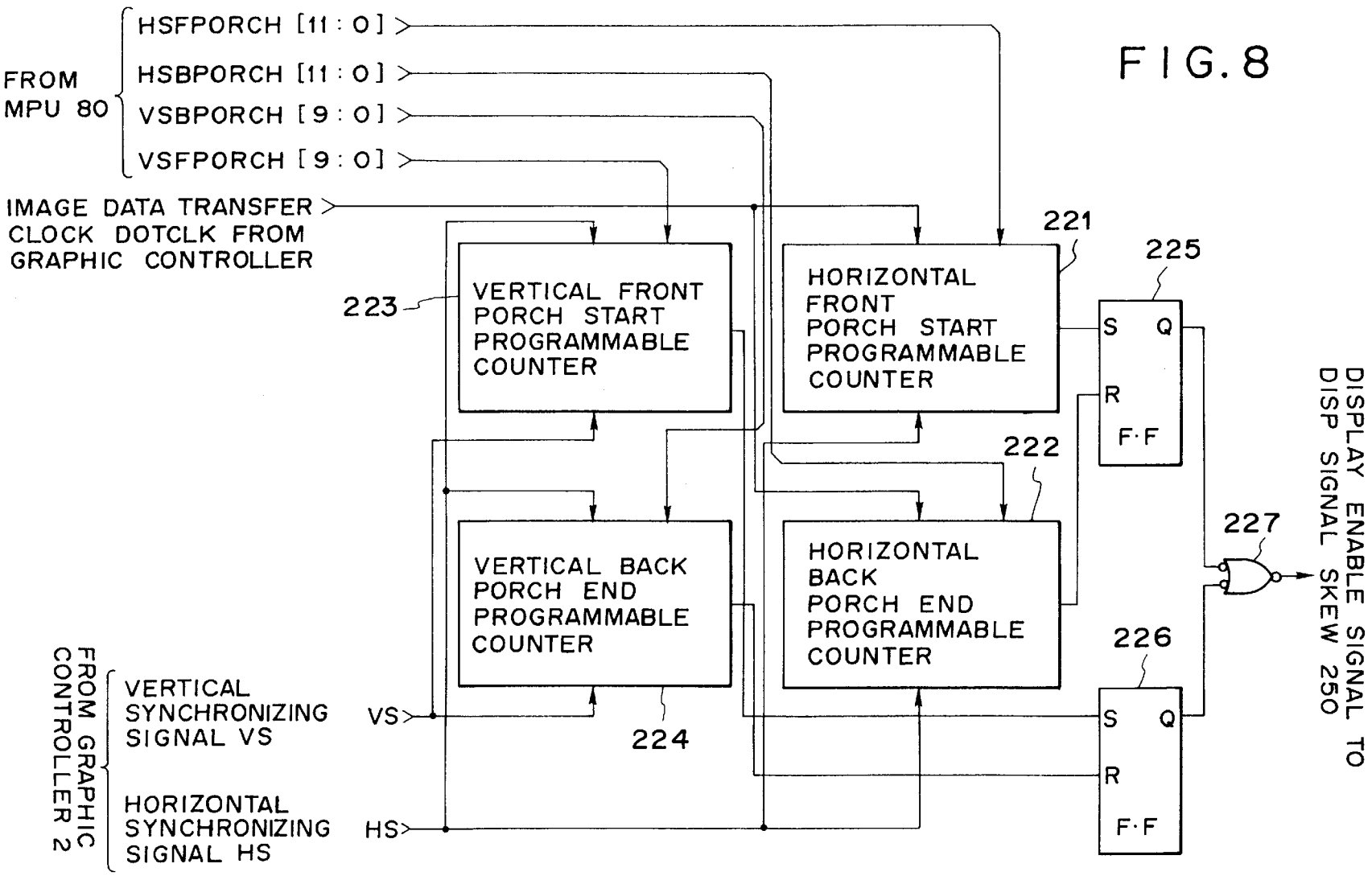
FIG. 8 is a circuit diagram of a border timing generator shown in FIG. 5.

The details of the border timing generator 220 will be described below. FIG. 8 is a circuit diagram of the border timing generator. A counter 221 is a horizontal front porch timing generation programmable counter, and loads the setting value HSFPORCH[11:0] from the MPU 80 during the low-level period of the horizontal synchronizing signal HS. When the horizontal synchronizing signal HS goes to high level, the counter 221 counts the image data transfer clocks DOTCLK. When the count reaches FFFH, the counter 221 generates a carry pulse.

A counter 222 is a horizontal back porch timing generation programmable counter, and loads the setting value HSBPORCH[11:0] from the MPU 80 during the low-level period of the horizontal synchronizing signal HS. When the horizontal synchronizing signal HS goes to high level, the counter 222 counts the image data transfer clocks DOTCLK. When the count reaches FFFH, the counter 222 generates a carry pulse.

A set-reset flip-flop 225 receives the carry pulse from the counter 221 at its set input, and the carry pulse from the counter 222 at its reset input, and generates a negative logic horizontal display enable signal.

Similarly, a counter 223 is a vertical front porch timing generation programmable counter, and loads the setting value VSFPORCH[9:0] from the MPU 80 during the low-level period of the vertical synchronizing signal VS. When the vertical synchronizing signal VS goes to high level, the counter 223 counts the horizontal synchronizing signal HS. When the count reaches 3FFH, the counter 223 generates a carry pulse.

A counter 224 is a vertical back porch timing generation programmable counter, and loads the setting value VSBPORCH[9:0] from the MPU 80 during the low-level period of the vertical synchronizing signal VS. When the vertical synchronizing signal VS goes to high level, the counter 224 counts the horizontal synchronizing signal HS. When the count reaches 3FFH, the counter 224 generates a carry pulse.

Figure 9:
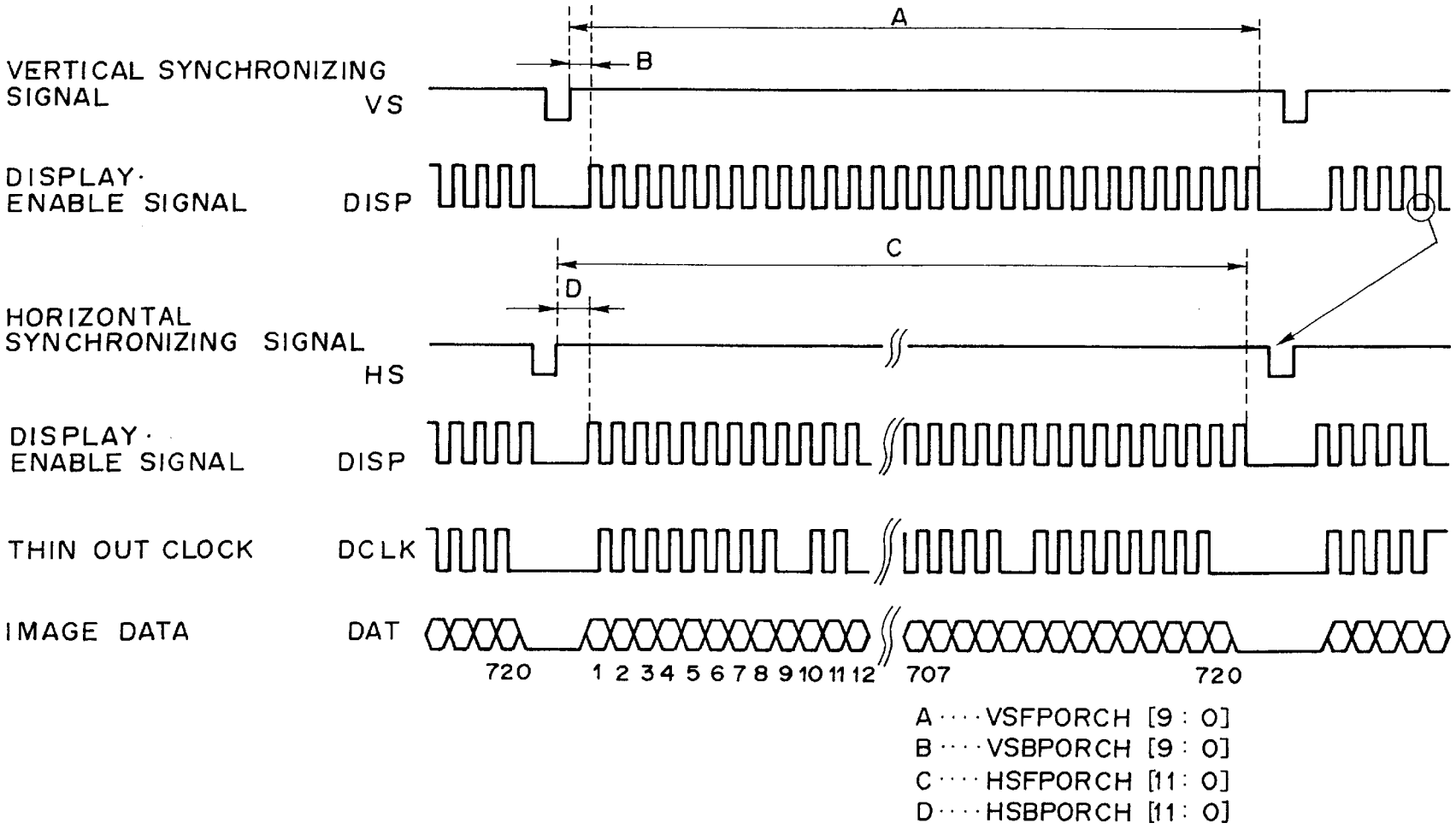
FIG. 9 is a timing chart of main signals in the circuit diagram of FIG. 8.

A set-reset flip-flop 226 receives the carry pulse from the counter 223 at its set input, and the carry pulse from the counter 224 at its reset input, and generates a negative logic vertical display enable signal. The display enable signal DISP is generated by adding the negative logic outputs from the flip-flops 225 and 226 by a negative logic OR gate 227. FIG. 9 is a timing chart showing the timings of the horizontal synchronizing signal HS, the vertical synchronizing signal VS, the display enable signal DISP, and the image data DAT.

(3.3) Mode Information Register

Figure 10:
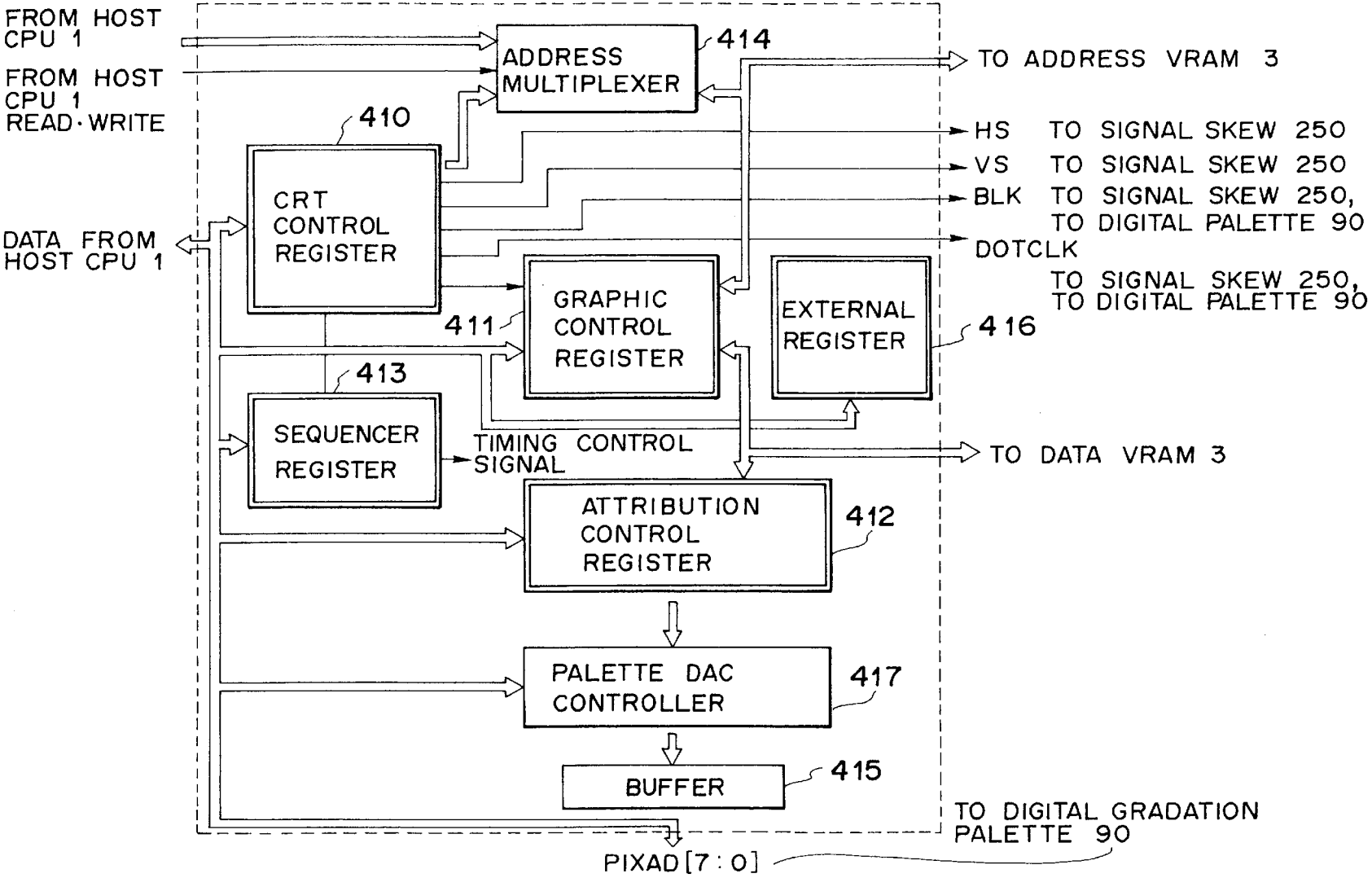
FIG. 10 is a block diagram of a graphic controller shown in FIG. 4.

The mode information register 100 (FIG. 5) stores mode information supplied from the host CPU 1. The graphic controller 2 (FIG. 4) includes five sets of registers, i.e., an external register 416, a CRT control register 410, a graphic control register 411, a sequencer register 413, and an attribution control register 412, as shown in FIG. 10.

The mode information register 100 is assigned with the same I/O addresses as those of the registers 416, 410, 411, and 413 of the graphic controller 2. In this embodiment, the mode information register 100 stores four sets of registers, i.e., the external register, the CRT control register, the graphic control register, and the sequencer register. Each register is constituted by a set of a plurality of data registers. The list of all the registers stored in the mode information register 100 will be presented below.

[External register]

Output operation register [MIS]

[CRT control section]

Horizontal total character count register [CRT(0)]

Horizontal display character count register [CRT(1)]

Horizontal blank start position register [CRT(2)]

Horizontal blank end position register [CRT(3)]

Horizontal synchronization pulse start position register [CRT(4)]

Horizontal synchronization pulse end position register [CRT(5)]

Vertical total raster count register [CRT(6)]

Most significant bit register [CRT(7)]

Start raster address register [CRT(8)]

Maximum raster address register [CRT(9)]

Cursor start raster register [CRT(0A)]

Cursor end raster register [CRT(0B)]

Start Address register <H> [CRT(0C)]

Start Address register <L> [CRT(0D)]

Cursor Register <H> [CRT(0E)]

Cursor Register <L> [CRT(0F)]

Vertical synchronizing pulse start position register [CRT (10)]

Vertical synchronizing pulse end position register [CRT (11)]

Vertical display raster count register [CRT(12)]

Memory width register [CRT(13)]

Underline register [CRT(14)]

Vertical blank start position register [CRT(15)]

Vertical blank end position register [CRT(16)]

CRT mode control register [CRT(17)]

Frame split position register [CRT(18)]

[Graphic control section]

Graphic address register

Graphic data register

Set-reset register [GRA(0)]

Enable set-reset register [GRA(1)]

Color compare register [GRA(2)]

Data rotate register [GRA(3)]

Read plane select register [GRA(4)]

Mode register [GRA(5)]

Graphic register [GRA(6)]

Color compare enable register [GRA(7)]

Bit mask register [(GRA(8)]

Processor latch register 0 [GRA(9)]

Processor latch register 1 [GRA(0A)]

Processor latch register 2 [GRA(0B)]

Processor latch register 3 [GRA(0C)]

[Sequencer control section]

Sequencer address register

Sequencer data register

Reset register [SEQ(0)]

Clock mode register [SEQ(1)]

Memory plane mask register [SEQ(2)]

Character font select register [SEQ(3)]

Memory mode register [SEQ(4)]

(3.3.1) Arrangement of Mode Information Register

Figure 11:
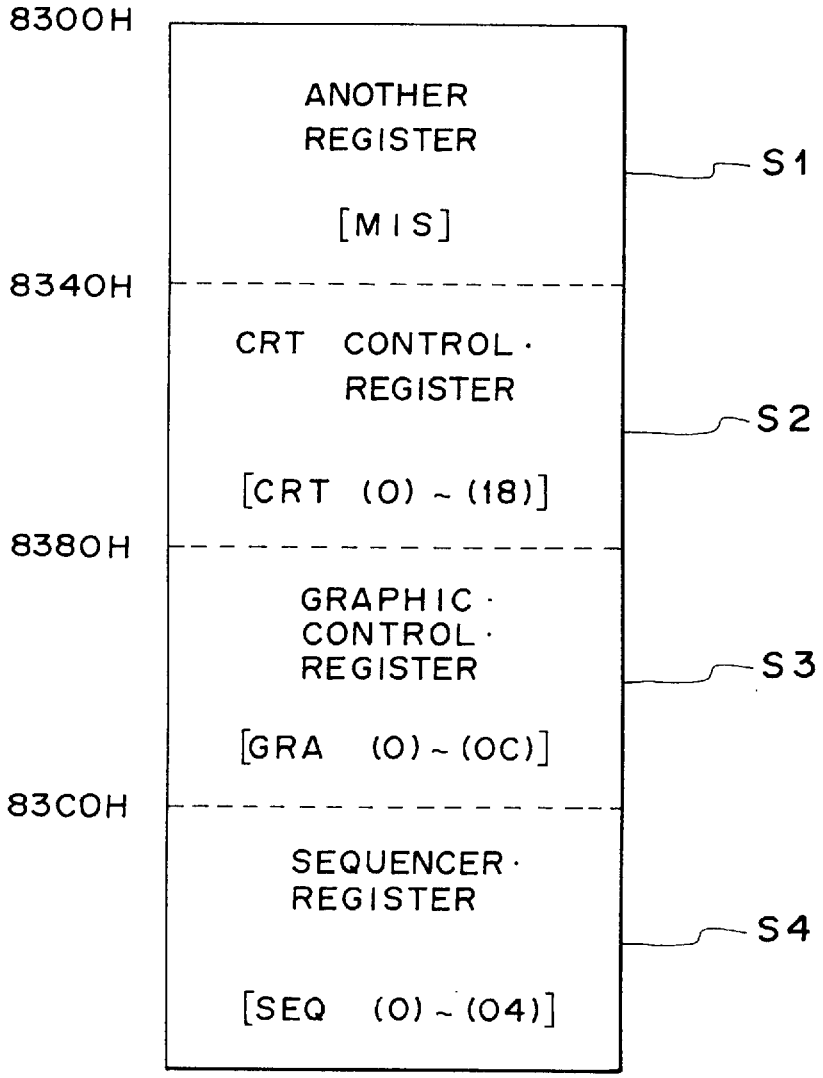
FIG. 11 shows the map of a mode information register shown in FIG. 5.

The details of the mode information register 100 (FIG. 5) will be described below. FIG. 11 shows the memory map of the mode information register 100 when viewed from the MPU 80 side. The register 100 adopts an 8-bit dual-port RAM, so that a write access from the CPU 1 and a read access from the MPU 80 can be independently made. In FIG. 11, S1 to S4 respectively correspond to the above-mentioned external register MIS, the CRT data registers CRT(0) to CRT(18), the graphic data registers GRA(0) to GRA(0C), and the sequencer data registers SEQ(0) to SEQ(4). The content of the register 100 is updated when one of the four sets of registers S1 to S4 is accessed by the host CPU 1.

A mode flag 101 (FIG. 5) comprises a flip-flop, whose output goes to high level in response to a signal obtained by decoding an address sent from the host CPU 1 by a decoder 125 and a write signal when one of the sets of registers S1 to S4 is accessed based on the address sent from the host CPU 1. The output from the mode flag 101 goes to high level simultaneously with the access, and informs to the MPU 80 that the content of the register 100 is updated. The MPU 80 clears the mode flag, and then loads the content of the register 100 from the graphic controller 2.

(3.4) Gradation Register

The gradation register 120 stores luminance gradation information supplied from the host CPU 1. The I/O addresses of the gradation register 120 are assigned to the same I/O ports as those used when the graphic controller 2 (FIG. 10) accesses a palette DAC controller 417. In this embodiment, the gradation register 120 stores RED (6 bits; 256 registers), GREEN (6 bits; 256 registers), and BLUE (6 bits; 256 registers).

(3.4.1) Arrangement of Gradation Register

Figure 12:
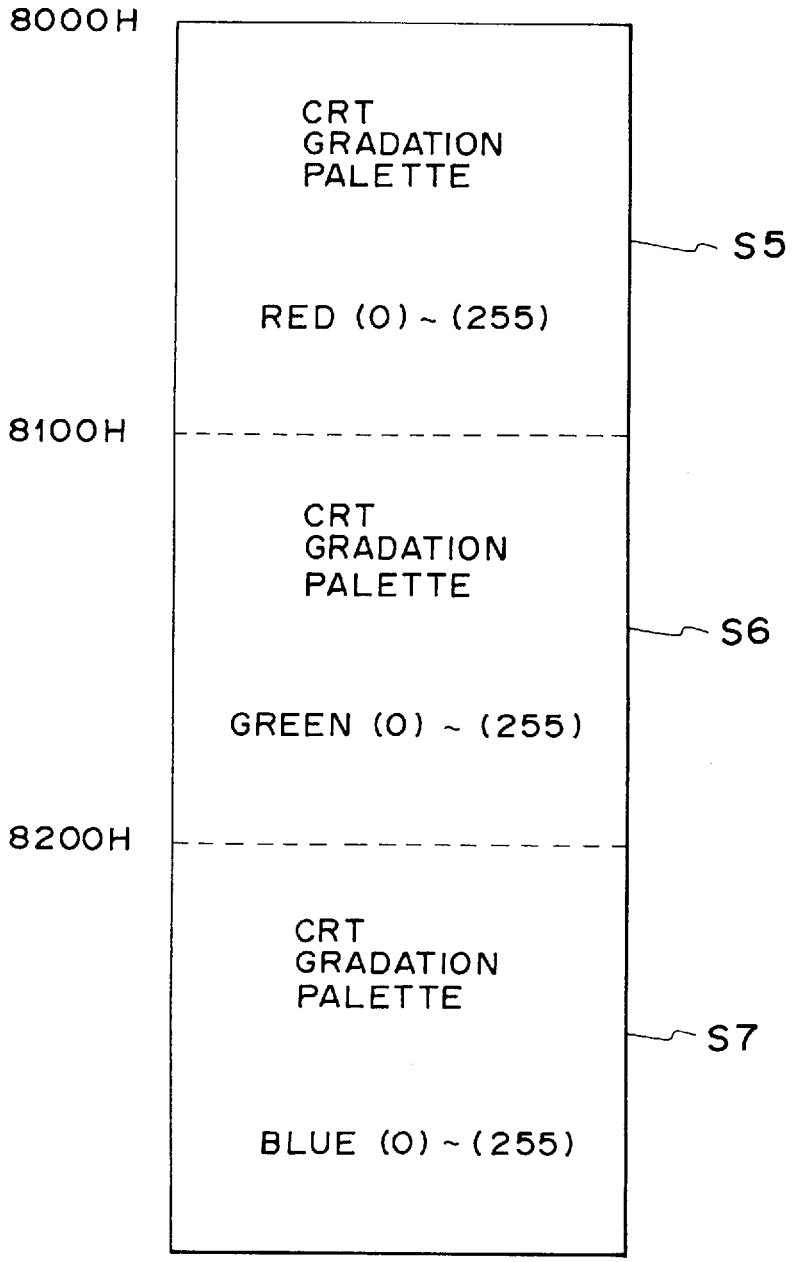
FIG. 12 shows the memory map of a gradation register shown in FIG. 5.

The details of the gradation register 120 will be described below. FIG. 12 shows the memory map of the gradation register 120 when viewed from the MPU 80 side. The register 120 adopts an 8-bit dual-port RAM, so that a write access from the CPU 1 and a read access from the MPU 80 can be independently made. In FIG. 12, S5 to S7 respectively correspond to RED (256 addresses), GREEN (256 addresses), and BLUE (256 addresses) of the luminance signal used in the CRT. The content of the register 120 is rewritten when the host CPU 1 accesses the palette DAC controller 417 (FIG. 10) of the graphic controller 2.

A gradation flag 121 (FIG. 5) comprises a flip-flop, whose output goes to high level in response to a signal obtained by decoding an address sent from the host CPU 1 by the decoder 125 and a write signal when one of registers S5 to S7 is accessed based on the address sent from the host CPU 1. The output from the gradation flag 121 goes to high level simultaneously with the access, and informs to the MPU 80 that the content of the register 120 is updated. The MPU 80 clears the gradation flag, and then loads the content of the register 120.

(3.5) Information Processing Section

The MPU 80 performs polling of the mode flag 101 and the gradation flag 121, and when one of these flags is at high level, it executes the corresponding processing. When the mode flag 101 is at high level, the MPU 80 executes mode identification processing, and when the gradation flag 121 is at high level, it executes gradation conversion processing. Upon completion of the processing, the MPU 80 sets "1" in a mode updating request flag or a gradation updating request flag allocated on its internal RAM area. Then, the MPU 80 performs polling of the mode updating request flag or the gradation updating request flag upon interruption from the graphic controller 2 during a low-level period (non-display period) of the vertical blank signal BLK. When the MPU 80 can confirm the mode or gradation data updating request, it executes processing required by an external circuit during the non-display period.

(3.5.1) Mode Information Identification Processing

Figure 13:
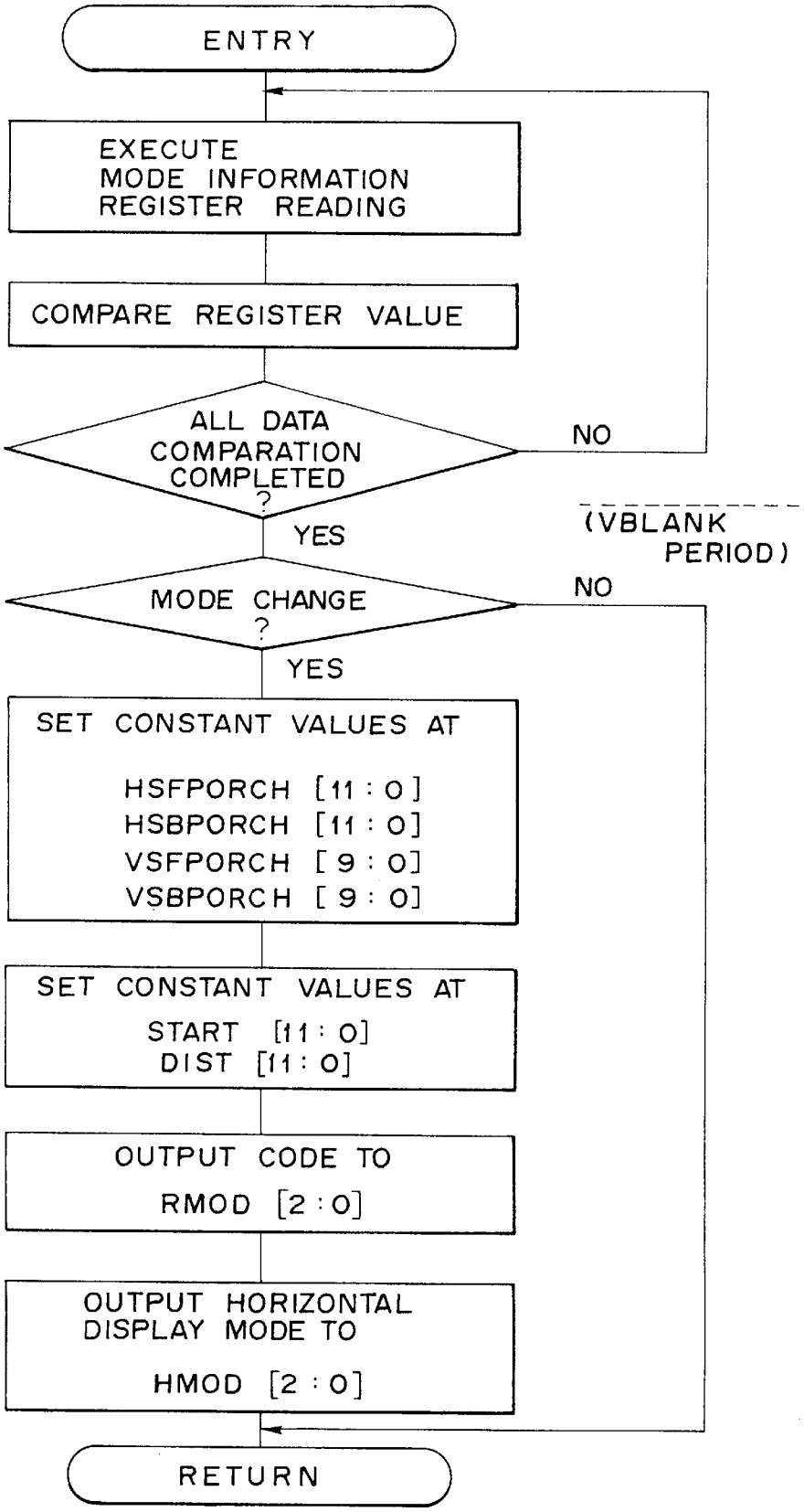
FIG. 13 is a flow chart showing mode identification processing executed by an MPU shown in FIG. 5.

The mode information identification processing will be described in detail below. FIG. 13 is a flow chart showing the mode information identification processing executed by the MPU 80. When the MPU 80 can confirm upon polling of the mode flag 101 that the mode information register 100 is updated, it reads the necessary register content of the mode information register 100. Then, the MPU 80 recognizes the mode by comparing the read register content and a table value on the basis of the judgment reference shown in FIG. 14. Upon completion of this processing, the MPU 80 sets "1" in the mode updating request flag. Thereafter, the MPU 80 enters the flag polling state, and if the gradation flag 121 is at high level, it executes the gradation processing. The MPU 80 starts the following processing after it confirms that the mode updating request flag is set to be "1" upon interruption during the low-level period (non-display period) of the vertical blank signal BLK from the graphic controller 2.

More specifically, the MPU 80 sets the constants HSFPORCH[11:0], HSBPORCH[11:0], VSFPORCH[9:0], and VSBPORCH[9:0] of the horizontal and vertical front and back porches. FIG. 15 shows values set in the border timing generator 220 by the MPU 80. The MPU 80 then sets the clock thin-out start position START[11:0] and the clock thin-out interval DIST[11:0] in the dot clock thin-out section 200. When the set mode is $0^+$, $1^+$, $2^+$, $3^+$, or $7^+$, the MPU 80 sets START[11:0]=0 and DIST[11:0]=9. This processing thins out image data to the number of effective display picture elements (2,560 picture elements)/$2^n$.

Figure 17:
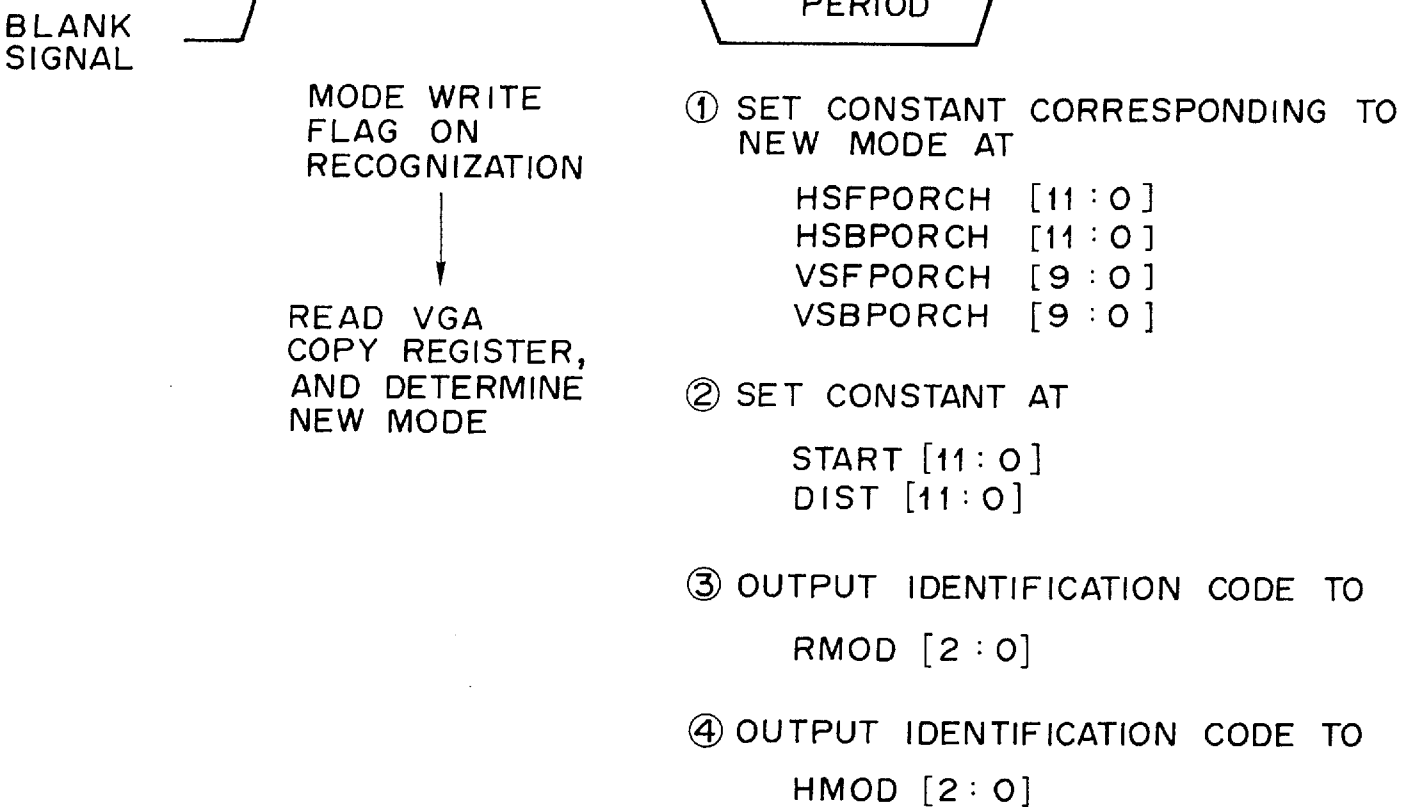
FIG. 17 is a timing chart showing a mode updating timing in the MPU.

As a result, the thin-out image data is enlarged to x$2^k$ by the pixel selector 150, and the enlarged data is displayed in the full horizontal width on the display device 340. The MPU 80 supplies the signal RMOD[2:0] to the controller 300. FIG. 16 shows the output code of the signal RMOD [2:0] to be supplied from the MPU 80 to the controller 300. The controller 300 discriminates the number of vertical lines based on the input signal, and supplies a control signal for simultaneously driving one or a plurality of scanning lines of the display device 340 to the common driver 320 and image data to the segment driver 321. With this operation, the vertical display frame size is controlled. Furthermore, the MPU 80 supplies the signal HMOD[1:0] for selecting a constant k for $\times 2^k$ enlargement in the pixel selector 150 to the pixel selector 150. Upon completion of all the processing operations, the MPU 80 resets the mode updating request flag to "0". FIG. 17 shows the execution timing of the mode updating processing. In FIG. 17, a term "blank" means a vertical blank.

(3.5.2) Gradation Conversion Processing

Figure 18:
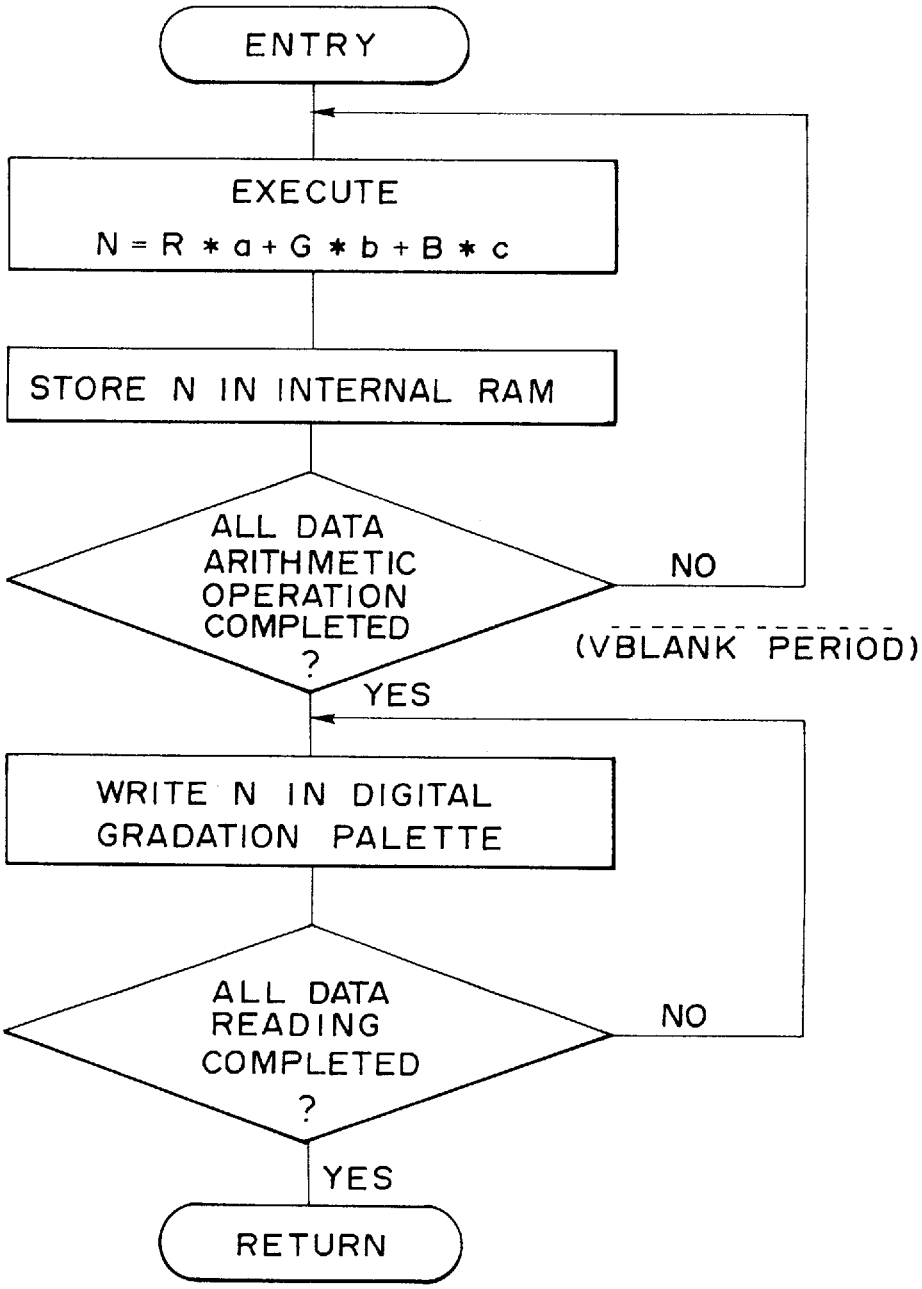
FIG. 18 is a flow chart of gradation conversion processing executed by the MPU.
Figure 20:
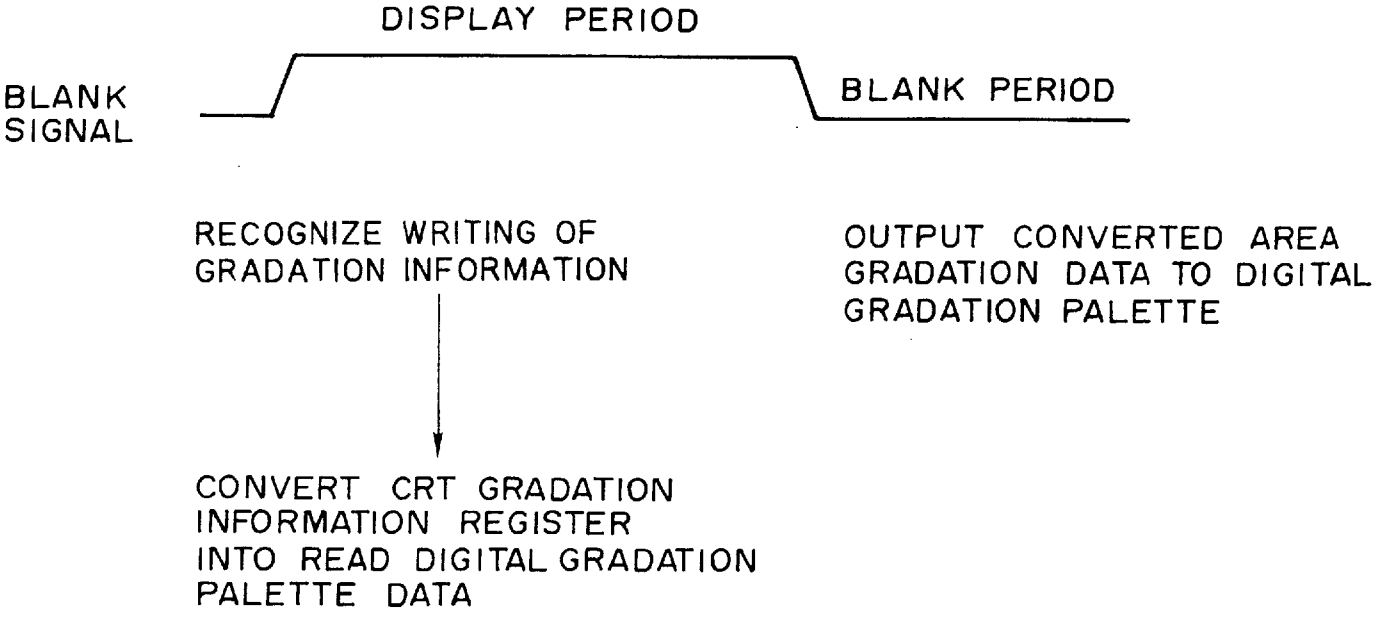
FIG. 20 is a timing chart showing the gradation data updating timing of the MPU.

The gradation conversion processing will be described in detail below. FIG. 18 is a flow chart showing gradation conversion processing executed by the MPU 80. When the MPU 80 confirms upon polling of the gradation flag 121 that the content of the gradation register 120 is updated, it selects a corresponding formula. The MPU 80 then reads the contents S5 (RED), S6 (GREEN), and S7 (BLUE) of the gradation register 120. The MPU 80 then executes an arithmetic operation RED×a+GREEN×b+BLUE×c. The arithmetic operation result is stored in a 256-byte gradation data buffer allocated on the internal RAM area of the MPU 80. Upon completion of the processing, the MPU 80 sets "1" in the gradation updating request flag. Thereafter, the MPU 80 enters the flag polling state, and if the mode flag 101 is at high level, it executes the mode information identification processing. The MPU 80 starts the following processing after it confirms that the gradation updating request flag is set to be "1" upon interruption during the low-level period (non-display period) of the vertical blank signal BLK from the graphic controller 2. The MPU 80 transfers gradation data from the gradation data buffer on the internal RAM area to the digital gradation palette 90. FIG. 19 shows a formula RED×2+GREEN×3+BLUE×1 in a 4-picture element/pixel mode, and its comparison table. Upon completion of all the processing operations, the MPU 80 resets the gradation updating request flag to "0". FIG. 20 shows the execution timing of the gradation conversion processing by the MPU 80. In FIG. 20, a term "blank" means a vertical blank.

(3.6) Output Controller (3.6.1) Arrangement of Digital Gradation Palette

Figure 21:
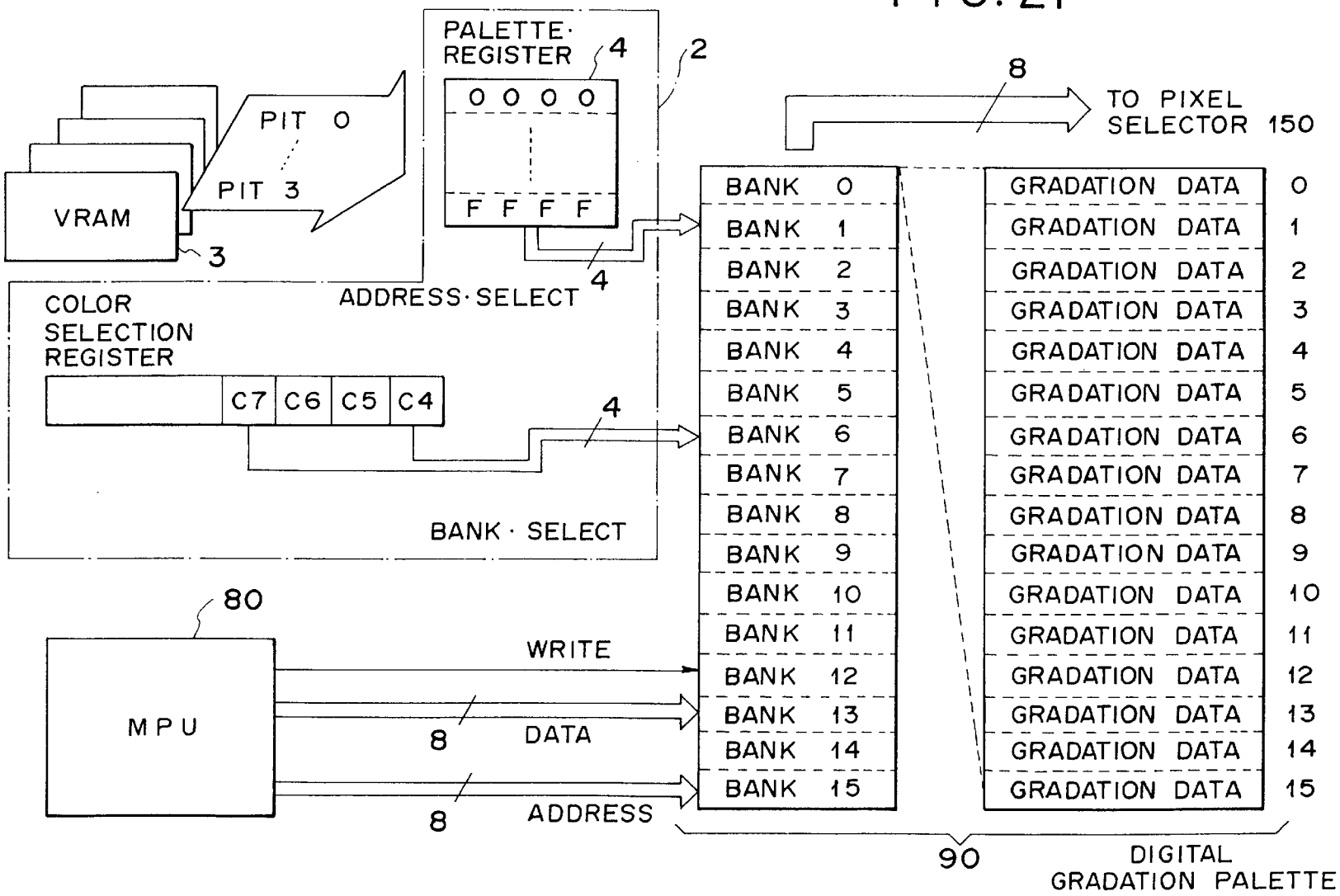
FIG. 21 is a circuit diagram of a digital gradation palette shown in FIG. 5.

FIG. 21 shows the arrangement of the digital gradation palette 90. FIG. 21 shows the arrangement for 16 gradation levels, and 16 banks. Luminance gradation data supplied from the host CPU 1 (FIG. 4) is temporarily stored in the gradation register 120 (FIG. 5), and is converted into area gradation data by the MPU 80. Thereafter, the area gradation data is written in gradation data registers of the digital gradation palette 90. The gradation conversion executed in this case is 4-picture element/pixel conversion shown in the table of FIG. 19. As the arithmetic operation result, 256 area gradation data are obtained, and are written in 256 8-bit gradation data registers of the digital gradation palette 90. The bank of the area gradation data is selected by a color selection register 5 in the graphic controller 2, and its address is selected by information from the VRAM 3. The selected data is supplied to the pixel selector 150 as area gradation data.

(3.6.2) Arrangement of Pixel Selector

Figure 22:
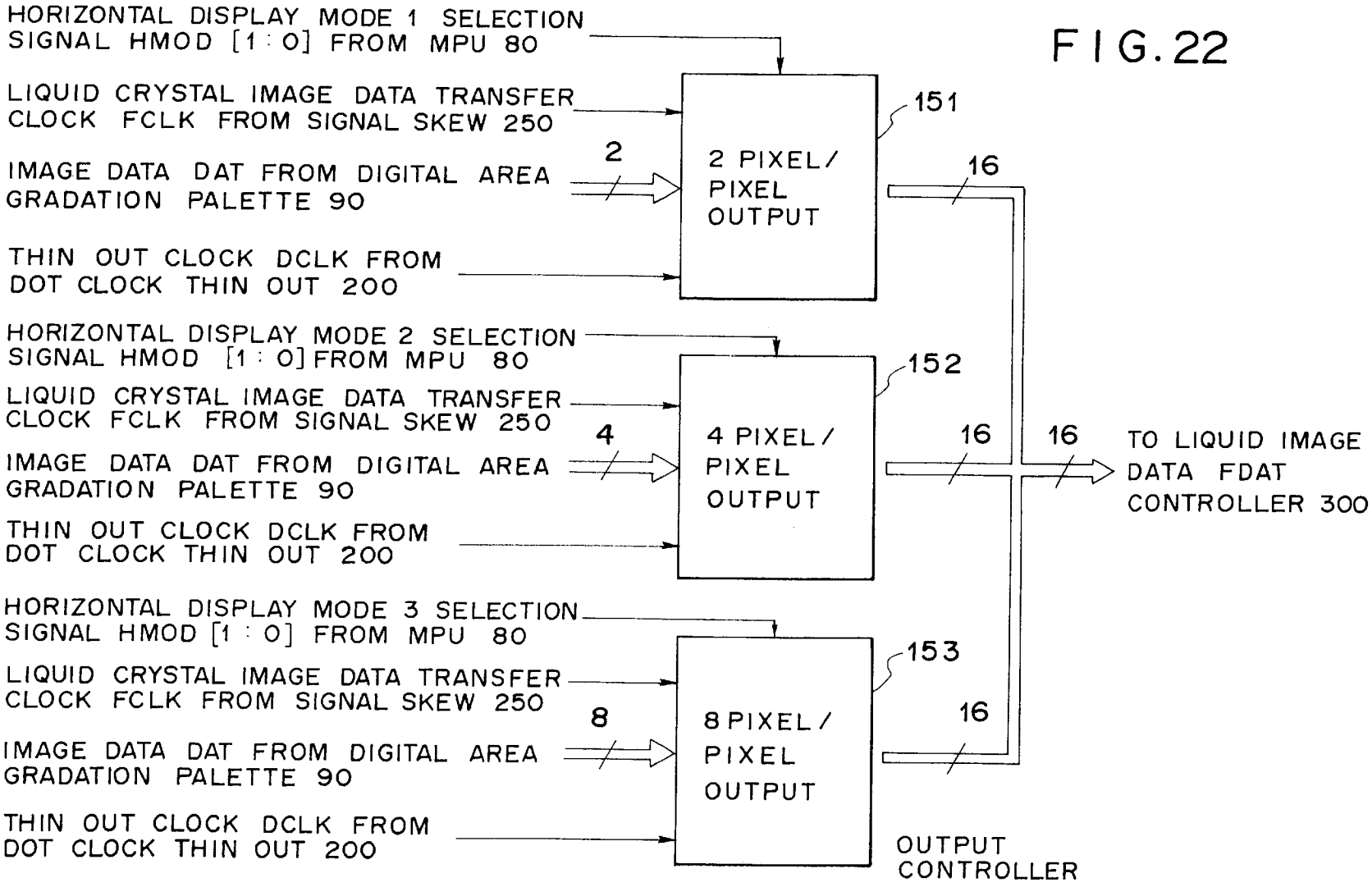
FIG. 22 is a circuit diagram of a pixel selector shown in FIG. 5.

FIG. 22 shows the arrangement of the pixel selector. In FIG. 22, the pixel selector 150 is constituted by a [2-picture element/pixel] output unit 151, a [4-picture element/pixel] output unit 152, and an [8-picture element/pixel] output unit 153. The pixel selector 150 selects a data output from one of these three control blocks according to a horizontal display mode 1, 2, or 3 selection signal HMOD[1:0] supplied from the MPU 80, and supplies the selected data output to the controller 300 as image data FDAT in the form of [picture element/pixel] in units of 16 bits. This selection is associated with the number of horizontal display pixels. For example, when a display matching with the number of picture elements of the horizontal effective display region of the effective display region 351 (FIG. 4) is to be performed, 1,280 pixels can be displayed on the display device 340 in the horizontal direction in the [2-picture element/pixel] mode; 640 pixels in the [4-picture element/pixel] mode; and 320 pixels in the [8-picture element/pixel] mode. The number of display lines in the vertical direction is adjusted by simultaneously driving one, two, or four scanning lines of the display device 340 according to a line mode 1, 2, or 3 selection signal RMOD[2:0] generated by the MPU 80 and supplied to the controller 300.

The details of the three output controllers will be described below.

(3.6.2.1) Circuit Arrangement of [2-picture element/pixel] Output Unit

Figure 23:
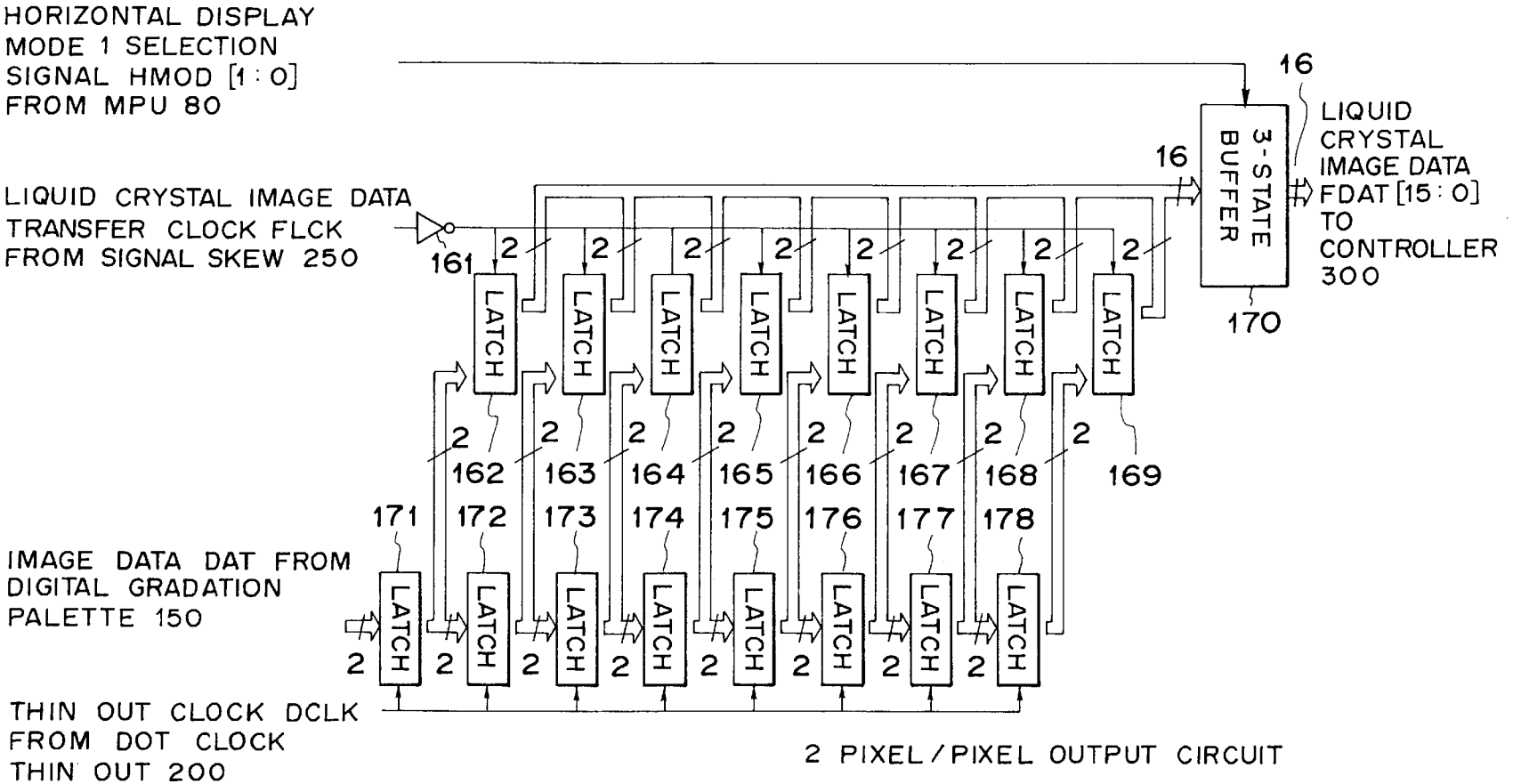
FIG. 23 is a circuit diagram of a 2-pixel (picture element) /pixel output unit shown in FIG. 22.

FIG. 23 shows the [2-picture element/pixel] output unit 151. Latch circuits 171 to 178 are registers for sequentially shifting the lower 2 bits of image data DAT supplied from the digital gradation palette 90 according to the thin-out clocks DCLK supplied from the dot clock thin-out section 200. Latch circuits 162 to 169 hold eight sets of [2-picture element/pixel] data at the timings of the leading edges obtained by inverting the liquid crystal image data transfer clocks FCLK supplied from the signal skew section 250 by an inverting gate 161. The held data is supplied from a 3-state buffer gate 170 controlled by the horizontal display mode 1 selection signal HMOD[1:0] supplied from the MPU 80 to the controller 300 as liquid crystal image data FDAT. When high-definition display data having the number of CRT horizontal display pixels exceeding 640 pixels is supplied from the VRAM 3, the [2-picture element/pixel] mode is selected. The modes $2^+$, $3^+$, and $7^+$ having the 720 horizontal display pixels originally correspond to such high-definition display. However, in this embodiment, since pixels are thinned out at 9-pixel intervals by the dot clock thin-out section 200, the above-mentioned modes are processed as a 640-pixel display mode.

(3.6.2.2) Circuit Arrangement of [4-picture element/pixel] Output Unit

Figure 24:
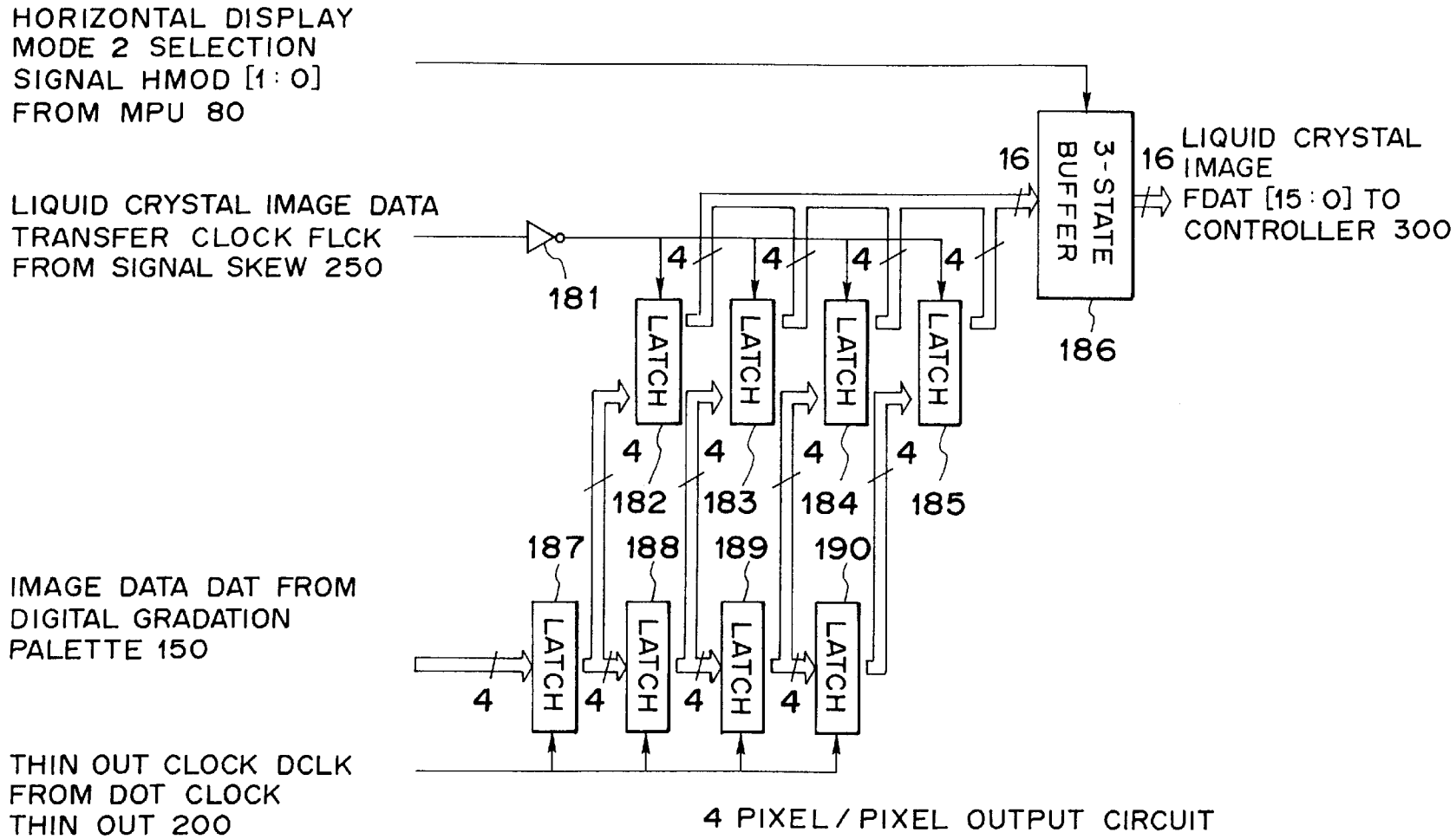
FIG. 24 is a circuit diagram of a 4-pixel (picture element) /pixel output unit shown in FIG. 22.

FIG. 24 shows the [4-picture element/pixel] output unit. Latch circuits 187 to 190 are registers for sequentially shifting the lower 4 bits of image data DAT supplied from the digital gradation palette 90 according to the thin-out clocks DCLK supplied from the dot clock thin-out section 200. Latch circuits 182 to 185 hold four sets of [4-picture element/pixel] data at the timings of the leading edges obtained by inverting the liquid crystal image data transfer clocks FCLK supplied from the signal skew section 250 by an inverting gate 181. The held data is supplied from a 3-state buffer gate 186 controlled by the horizontal display mode 2 selection signal HMOD[1:0] supplied from the MPU 80 to the controller 300 as liquid crystal image data FDAT. In this embodiment, the [4-picture element/pixel] mode is selected in the modes $0^+$, $1^+$, $2^+$, $3^+$, $7^+$, 6, E, F, 10, 11, and 12.

(3.6.2.3) Circuit Arrangement of [8-picture element/pixel] Output Unit

Figure 25:
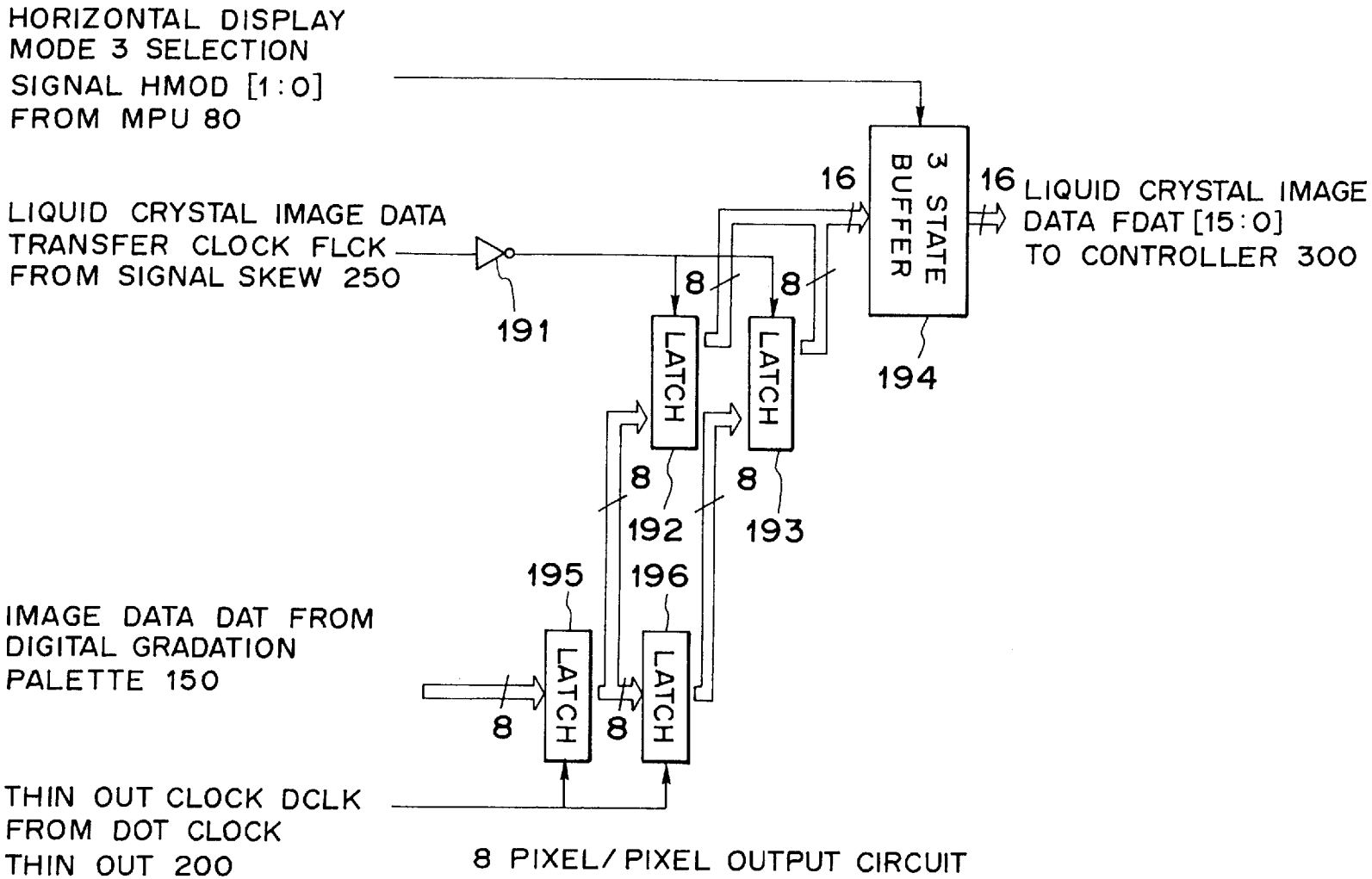
FIG. 25 is a circuit diagram of an 8-pixel (picture element)/pixel output unit shown in FIG. 22.

FIG. 25 shows the [8-picture element/pixel] output unit. Latch circuits 195 and 196 are registers for sequentially shifting the lower 8 bits of image data DAT supplied from the digital gradation palette 90 according to the thin-out clocks DCLK supplied from the dot clock thin-out section 200. Latch circuits 192 and 193 hold two sets of [8-picture element/pixel] data at the timings of the leading edges obtained by inverting the liquid crystal image data transfer clocks FCLK supplied from the signal skew section 250 by an inverting gate 191. The held data is supplied from a 3-state buffer gate 194 controlled by the horizontal display mode 3 selection signal HMOD[1:0] supplied from the MPU 80 to the controller 300 as liquid crystal image data FDAT. When the number of CRT horizontal display pixels is equal to or smaller than 320 pixels and multi-gradation level display is to be performed, the [8-picture element/pixel] mode is selected. In this embodiment, the [8-picture element/pixel] mode is selected in the modes 4, 5, D, and 13 having 320 horizontal display pixels.

(3.6.3) Circuit Arrangement of Signal Skew Section

Figure 27:
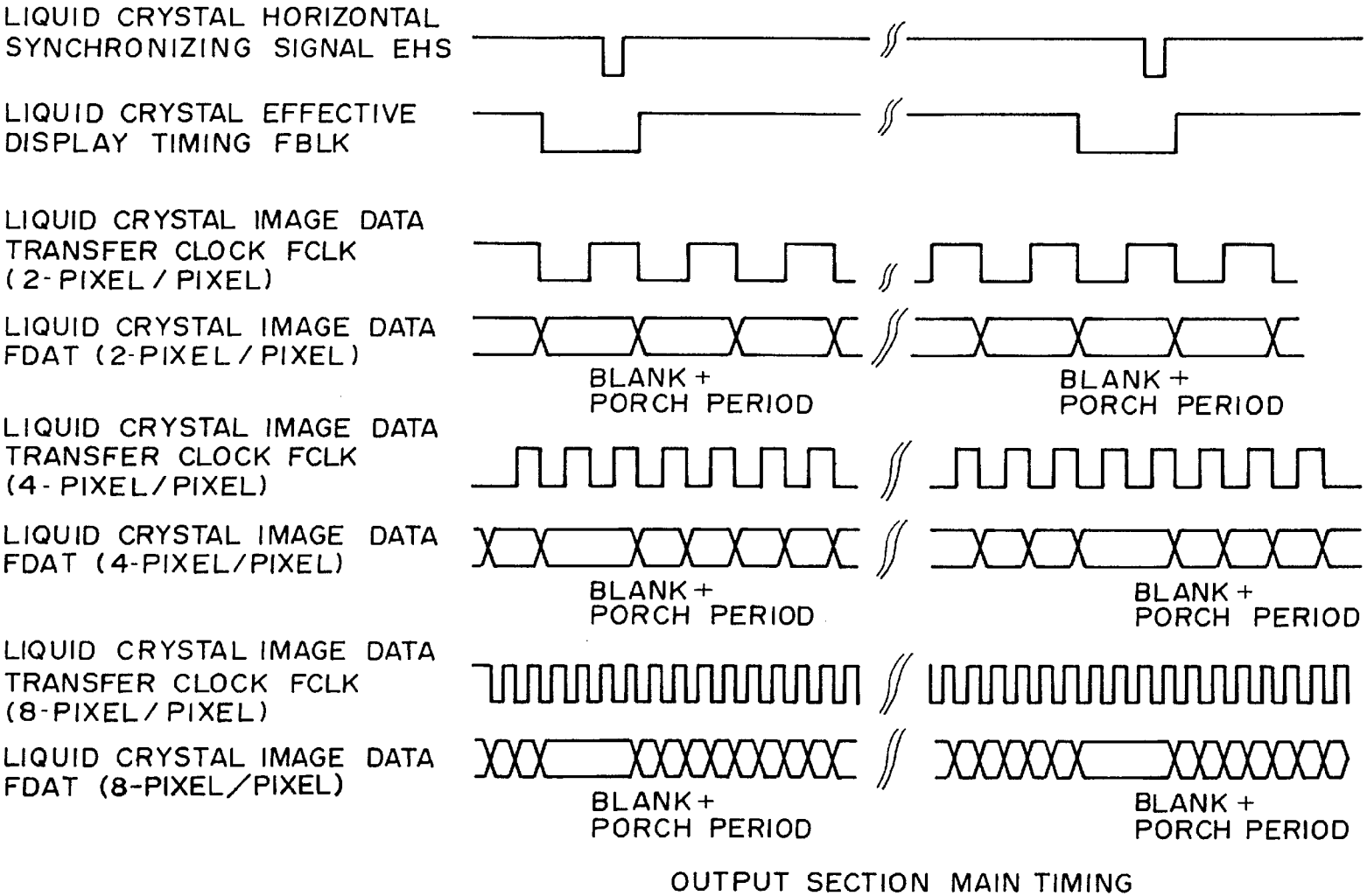
FIG. 27 is a timing chart of main signals in an output section (the pixel selector and the signal skew section).

FIG. 26 shows the circuit arrangement of the signal skew section. Components 255 to 259 constitute a circuit for generating the liquid crystal image data transfer clocks FCLK, and programmable shift registers 251 to 254 respectively delay the liquid crystal display timing signal FBLK, the vertical synchronizing signal FVS, the horizontal synchronizing signal FHS, and the dot clock signal FCLK. These shift registers are programmed with a delay time for N clocks according to the mode 1, 2, or 3 selection signal HMOD[1:0]. The outputs, i.e., the liquid crystal vertical synchronizing signal FVS, the liquid crystal horizontal synchronizing signal FHS, the liquid crystal image data transfer clocks FCLK, and the liquid crystal display timing signal FBLK from the programmable shift registers 251 to 254 are supplied to the controller 300. The controller 300 performs a setting operation of a driving voltage and a line thin-out operation of image data on the basis of information from the thermosensor 330, and drives the common driver 320 and the segment driver 321, thereby performing a display on the display device 340. FIG. 27 shows the main output timings of the respective blocks in the output controller.

According to the present invention, image data which does not influence a displayed image can be thinned out according to a start position and interval set in an image data thin-out operation section. The thin-out image data is enlarged to $\times 2^n$ as needed together with gradation data, and the enlarged data is displayed on a display device. Therefore, graphic data having a plurality of horizontal display size modes can be optimally displayed by a display device having a specific number of effective display picture elements without using a display device having a plurality of modes with different numbers of horizontal picture elements. When the display size is smaller than the effective display area of the display device, image data is displayed at the central position, and the remaining portion is displayed as a border portion in a designated size.

What is claimed is:

1. A device for processing first image data, corresponding to a first number of pixels on a display, to display second image data corresponding to a predetermined second number of pixels on said display, said device comprising:

thinning out means for receiving a series of plural clock pulses synchronized with the first image data, and for outputting a series of thinned out clock pulses formed by thinning out the series of received clock pulses at a compression ratio, thereby compressing the first image data, wherein said compression ratio is not $1/2^n$, n being a natural number; and extension means for extending the compressed first image data in an extension ratio, wherein said extension ratio is $2^n$, so that one pixel of the compressed first image data is extended to correspond to $2^n$ of the pixels of the display.

2. A device according to claim 1, further comprising means for displaying the second image data by enlarging the thinned out first image data, in synchronism with the thinned out clock pulses, by a factor of $2^n$, where n is a whole number.

3. A device according to claim 1, further comprising means for setting a thin-out start position and a thin-out interval of the first image data.

4. A device according to claim 1, further comprising means capable of arbitrarily changing sizes of horizontal and vertical border display regions.

5. A device according to claim 1, wherein said device is connected to a graphic controller including a memory for storing the first image data.

6. A device according to claim 5, wherein said graphic controller is connected to a computer, and wherein said graphic controller stores the first image data in said memory according to an instruction from said computer.

7. A display device comprising:

a display having a plurality of pixels; and signal processing means for processing first image data, corresponding to a first pixel number of pixels in said display, to display, on said display, second image data corresponding to a second pixel number of pixels, said signal processing means including:

thinning out means for receiving a series of plural clock pulses synchronized with the first image data, and for outputting a series of thinned out clock pulses formed by thinning out the series of received clock pulses at a compression ratio, thereby compressing the first image data wherein said compression ratio is not $1/2^n$, n being a natural number; and extension means for extending the compressed first image data in an extension ratio, wherein said extension ratio is $2^n$, so that one pixel of the compressed first image data is extended to correspond to $2^n$ of the pixels of the display.

8. A device according to claim 7, wherein the plural clock pulses are thinned out to erform a display on a display screen of an arbitrary horizontal display size.

9. A device according to claim 7, wherein said display device further comprises means for displaying the second image data by enlarging the compressed first image data, in synchronism with the thinned out plural clock pulses, by a factor of $2^n$, where n is a whole number.

10. A device according to claim 7, wherein said display device further comprises means for setting a thin-out start position and a thin-out interval of the first image data.

11. A device according to claim 7, wherein said display device further comprises means capable or arbitrarily changing sizes of horizontal and vertical border display regions.

12. A device according to claim 7, wherein said display includes a ferroelectric liquid crystal material.

13. A device according to claim 7, wherein said display device re-arranges the first image data in synchronism with the series of thinned out clock pulses as second image data for said display means.

14. A display device according to claim 7, wherein said display has segment driver and common driver for driving said display.

15. A display device according to claim 7, wherein said display has a light source for illuminating the pixels of said display.

16. A device according to claim 7, wherein an area of said display aside from a displaying area corresponding to the extended image data is maintained at a predetermined optical state as a border section.

17. An apparatus for driving a display including a plurality of pixels, said apparatus comprising:

a driver for driving the display;

a controller for controlling said driver; and signal processing means for producing extended image data from first image data corresponding to a first number of pixels in the display, said extended image data corresponding to a second number of pixels, and said signal processing means including:

thinning out means for receiving a series of plural clock pulses synchronized with the first image data, and for outputting thinned out clock pulses formed by thinning out the series of received clock pulses at a compression ratio, thereby compressing the first image data, wherein said compression ratio is not $1/2^n$, n being a natural number; and extension means for extending the compressed first image data, to extended image data, in an extension ratio, wherein said extension ratio is $2^n$, wherein said controller controls said driver based on the extended image data and wherein one pixel of the compressed first image data is extended to correspond to $2^n$ of the pixels of the display.

18. A display device comprising:

a display having a plurality of pixels; and a signal processor for processing first image data corresponding to a first number of pixels to display, on said display, second image data corresponding to a second number of pixels, said signal processing means including:

a thinning out circuit for receiving a series of plural clock pulses synchronized with the first image data, and for outputting a series of thinned out clock pulses formed by thinning out the series of received clock pulses at a compression ratio thereby compressing the first image data, wherein said compression ratio is not $1/2^n$, n being a natural number;

an extension circuit for extending the compressed first image data in an extension ratio, wherein said extension ratio is $2^n$, so that one pixel of the compressed first image data is extended to correspond to $2^n$ of the pixels of the display.

19. A device according to claim 18, wherein an area of said display aside from a displaying area corresponding to the extended image data is maintained at a predetermined optical state as a border section.

20. An apparatus for supplying image data to a display including a plurality of pixels of a first number, a driver for driving the display, and a controller for controlling the driver, said apparatus comprising:

a signal processor for producing, extended image data from the image data, the extended image data corresponding to a second number of pixels, said signal processor including:

a thinning out circuit for receiving a series of plural clock pulses synchronized with the image data, and for outputting thinned out clock pulses formed by thinning out the series of received clock pulses at a compression ratio, thereby compressing the image data of the first number of pixels into other image data of a thinned out number of pixels smaller than the first number, wherein said compression ratio is not $1/2^n$, n being a natural number; and an extension circuit for extending the compressed image data to the extended image data in an extension ratio, wherein said extension ratio is $2^n$, so that one pixel of the compressed image data is extended to correspond to $2^n$ of pixels of the display, wherein the controller controls the driver based on the extended image data.

21. A device according to claim 20, wherein an area of said display aside from a displaying area corresponding to the extended image data is maintained at a predetermined optical state as a border section.

22. An apparatus for supplying image data to a display including a plurality of pixels of a first number, a driver for driving the display, and a controller for controlling the driver, said apparatus comprising:

a signal processor for producing extended image data from the image data, the extended image data corresponding to a second number of pixels, said signal processor including:

a thinning out circuit for receiving a series of plural clock pulses synchronized with the first image data, and for outputting thinned out clock pulses formed by thinning out the series of received clock pulses at a compression ratio, wherein said compression ratio is not $1/2^n$, n being a natural number, thereby compressing the first image data of the first number of pixels into other image data of a thinned out number of pixels smaller than the first number; and an extension circuit for extending the compressed image data to the extended image data in an extension ratio, wherein said extension ratio is $2^n$, so that one pixel of the compressed first image data is extended to correspond to $2^n$ of pixels of the display.

23. A device according to claim 22, wherein an area of said display aside from a displaying area corresponding to the extended image data is maintained at a predetermined optical state as a border section.

24. A device for processing first image data, corresponding to a first number of pixels on a scanning line of a display, to display second image data corresponding to a predetermined second number of pixels on said scanning line of said display, said device comprising:

thinning out means for receiving a series of plural clock pulses synchronized with the first image data, and for outputting a series of thinned out clock pulses formed by thinning out the series of received clock pulses at a compression ratio, thereby compressing the first image data wherein said compression ratio is not $1/2^n$, n being a natural number; and extension means for extending the compressed first image data in an extension ratio, wherein said extension ratio is $2^n$, so that one pixel of the compressed first image data is extended to correspond to $2^n$ n of the pixels on said scanning line of the display.

25. A device according to any of claims 1, 7 and 18 wherein said first and second image data is displayed at a pixel on one scanning line of said display.

26. An apparatus according to any of claims 17, 20 and 22, wherein said first and second image data is displayed at a pixel on one scanning line of said display.

* * * * *

UNITED STATES PATENT AND TRADEMARK OFFICE

CERTIFICATE OF CORRECTION

PATENT NO. : 5,805,149

DATED : September 8, 1998

INVENTOR(S) : OSAMU YUKI ET AL.

It is certified that error appears in the above-identified patent and that said Letters Patent is hereby corrected as shown below:

COVER PAGE [56] References Cited

FOREIGN PATENT DOCUMENTS,

"6358865" should read --63-58865--.
"2156288" should read --2-156288--.
"Fitzpatrick,Cella," should read --Fitzpatrick, Cella,--.
"89/10609 2/1989 Japan" should read --89/10609 2/1989 WIPA--.

COLUMN 5

Line 45, "brightp" should read --bright--.

COLUMN 15

Line 39, "erform" should read --perform--.

Signed and Sealed this

Eighth Day of June, 1999

*Attest:*

Q. TODD DICKINSON

*Attesting Officer*

*Acting Commissioner of Patents and Trademarks*